US006482373B1

(12) United States Patent
Hannaford et al.

(10) Patent No.: US 6,482,373 B1
(45) Date of Patent: Nov. 19, 2002

(54) PROCESS FOR TREATING ORE HAVING RECOVERABLE METAL VALUES INCLUDING ARSENIC CONTAINING COMPONENTS

(75) Inventors: Anthony L. Hannaford, Littleton, CO (US); K. Marc Le Vier; Rene R. Fernandez, both of Salt Lake City, UT (US); Gopalan Ramadorai, Tuscon, AZ (US); Arno Fitting, Neu-Anspach (DE); Gurudas Samant, Fronhausen (DE); Bodo Peinemann; Gebhard Bandel, both of Frankfurt am Main (DE); Hans Kofalck, Hattersheim (DE)

(73) Assignee: Newmont USA Limited, Denver, CO (US)

( * ) Notice: Subject to any disclaimer, the term of this patent is extended or adjusted under 35 U.S.C. 154(b) by 0 days.

(21) Appl. No.: 08/462,760

(22) Filed: Jun. 5, 1995

Related U.S. Application Data

(63) Continuation of application No. 07/864,241, filed on Apr. 10, 1992, now abandoned, and a continuation-in-part of application No. 07/684,649, filed on Apr. 12, 1991, now Pat. No. 5,123,956.

(30) Foreign Application Priority Data

Jul. 11, 1991 (DE) ..... 41 22 894
Jul. 11, 1991 (DE) ..... 41 22 895

(51) Int. Cl.[7] ..... C01G 7/00; C22B 11/00
(52) U.S. Cl. ..... 423/47; 423/27; 423/29
(58) Field of Search ..... 423/47, 27, 29; 75/421, 419, 422, 423

(56) References Cited

U.S. PATENT DOCUMENTS

| | | | | | |
|---|---|---|---|---|---|
| 42,997 | A | * | 5/1864 | Rivot | 423/47 |
| 46,520 | A | * | 2/1865 | Bradford | 423/47 |
| 53,742 | A | * | 4/1866 | Mason | 423/47 |
| 75,293 | A | * | 3/1868 | Ott | 75/421 |
| 253,104 | A | * | 6/1882 | De Figaniere | 423/47 |
| 290,213 | A | * | 12/1883 | Cherry, Sr. | 423/47 |
| 360,904 | A | * | 4/1887 | Parnell | 423/47 |
| 1,111,976 | A | * | 9/1914 | Titus | 423/47 |
| 1,131,691 | A | * | 3/1915 | Fusina | 423/47 |
| 1,257,612 | A | * | 2/1918 | Kirchen et al. | 423/47 |
| 1,876,943 | A | * | 9/1932 | Hull | 75/421 |
| 1,943,339 | A | * | 1/1934 | Mitchell | 423/47 |
| 2,596,580 | A | * | 5/1952 | McKay et al. | 423/47 |
| 2,650,159 | A | * | 8/1953 | Tarr, Jr. et al. | 423/47 |
| 2,829,964 | A | | 4/1958 | Zimmerley et al. | 423/53 |
| 2,878,102 | A | | 5/1959 | Sternfels | 423/26 |
| 3,169,856 | A | | 2/1965 | Mero | 423/150.4 |
| 3,172,755 | A | | 3/1965 | Vian-Ortuno | 423/29 |
| 3,305,353 | A | | 2/1967 | Duncan et al. | 423/DIG. 17 |
| 3,330,650 | A | | 7/1967 | Zimmerley et al. | 423/DIG. 17 |
| 3,418,237 | A | | 12/1968 | Booth et al. | 252/303 |
| 3,433,629 | A | | 3/1969 | Imai et al. | 75/101 |
| 3,455,679 | A | | 7/1969 | Mayling | 75/101 |
| 3,479,177 | A | * | 11/1969 | Veronica et al. | 423/152 |
| 3,607,235 | A | | 9/1971 | Duncan et al. | 423/DIG. 17 |
| 3,660,073 | A | | 5/1972 | Youngs et al. | 75/3 |
| 3,679,397 | A | | 7/1972 | O'Connor et al. | 423/DIG. 17 |
| 3,777,004 | A | | 12/1973 | Lankenau | 423/27 |
| 3,791,812 | A | * | 2/1974 | Frank et al. | 423/27 |
| 3,819,797 | A | | 6/1974 | Spedden et al. | 423/27 |
| 3,823,009 | A | | 7/1974 | Lallach et al. | 75/321 |
| 3,860,414 | A | | 1/1975 | Lang et al. | 75/3 |
| 3,893,847 | A | | 7/1975 | Derrick et al. | 75/3 |
| 3,898,076 | A | | 8/1975 | Ranke et al. | 75/3 |
| 3,949,051 | A | | 4/1976 | Pawlek | 423/27 |
| 4,002,717 | A | | 1/1977 | Sandberg et al. | 423/24 |
| 4,013,606 | A | | 3/1977 | Ballweber et al. | 260/29.4 UA |
| 4,017,309 | A | | 4/1977 | Johnson | 423/27 |
| 4,021,394 | A | | 5/1977 | Tuka et al. | 260/29.4 UA |

(List continued on next page.)

FOREIGN PATENT DOCUMENTS

| | | | |
|---|---|---|---|
| AU | A 45769/85 | 5/1985 | |
| DE | 2742199 | 4/1978 | 423/DIG. 17 |
| DE | 43 29 417 | 9/1993 | |
| EP | 0 004 431 | 10/1979 | 423/DIG. 17 |
| EP | 0 508 542 | 4/1992 | |
| GB | 2180829 | 9/1986 | 423/DIG. 17 |
| JP | 47-14602 | 5/1972 | 423/DIG. 17 |
| JP | 79039 802 | 11/1979 | 423/DIG. 17 |
| SU | 0715483 | 2/1980 | 423/DIG. 17 |
| SU | 943309 | 2/1980 | 423/DIG. 17 |
| SU | 998549 | 2/1983 | 423/DIG. 17 |
| SU | 1227701 | 4/1986 | 423/DIG. 17 |
| SU | 1359324 | 12/1987 | 423/DIG. 17 |
| WO | WO 92/16667 | 10/1992 | |
| ZA | 85-3701 | 5/1985 | 423/DIG. 17 |

OTHER PUBLICATIONS

European Search Report for corresponding EP 92 20 0989, now EP 508,542, no date.*

Abstract for FR 2,478,672, Sep. 1981.*

(List continued on next page.)

*Primary Examiner*—Steven Bos
(74) *Attorney, Agent, or Firm*—Marsh Fischmann & Breyfogle LLP

(57) ABSTRACT

Roasting of ores with metal values such as precious metal ores for recovery of metal values with conversion of arsenic to an insoluble form in-situ in presence of an additive such as iron and in presence of oxygen injected initially or supplementally in a roaster such as in a circulating fluid bed roaster; volatilized arsenic in roasting of ores may also be converted to an insoluble form in gas phase in a two stage roaster process after removal of solids from a gas phase and contact with an additive at high oxygen concentration in a second stage roaster.

28 Claims, 11 Drawing Sheets

U.S. PATENT DOCUMENTS 4,056,261 A 11/1977 Darrah ..... 266/101
4,062,817 A 12/1977 Westerman ..... 260/17.45 G
4,070,182 A 1/1978 Genik -Sas-Berezowsky et al. ..... 423/32
4,076,633 A 2/1978 Edwards et al. ..... 427/212
4,128,528 A 12/1978 Frisque et al. ..... 260/42.55
4,162,996 A 7/1979 Parrini et al. ..... 260/4 R
4,179,369 A 12/1979 Bradley et al. ..... 210/43
4,222,861 A 9/1980 Finch ..... 209/166
4,222,862 A 9/1980 Finch ..... 209/166
4,233,411 A 11/1980 Ballweber et al. ..... 525/155
4,238,330 A 12/1980 Fong et al. ..... 210/708
4,256,705 A 3/1981 Heinen et al. ..... 423/27
4,256,706 A 3/1981 Heinen et al. ..... 423/29
4,269,622 A 5/1981 Kerley, Jr. ..... 423/32
4,269,699 A 5/1981 McCready et al. .. 423/DIG. 17
4,279,868 A 7/1981 von Kohorn ..... 423/29
4,293,333 A 10/1981 Drobot ..... 423/22
4,293,334 A 10/1981 Drobot et al. ..... 423/22
4,301,121 A 11/1981 von Kohorn ..... 423/1
4,318,892 A 3/1982 von Kohorn ..... 423/27
4,324,764 A 4/1982 Hasegawa et al. ..... 266/101
4,343,773 A 8/1982 Miller et al. ..... 423/27
4,362,559 A 12/1982 Perez et al. ..... 75/53
4,369,061 A 1/1983 Kerley, Jr. ..... 423/32
4,374,097 A 2/1983 Holland ..... 423/29
4,376,647 A * 3/1983 Sohn ..... 423/47
4,402,831 A 9/1983 Beardsmore et al. ..... 210/606
4,405,728 A 9/1983 Krebs et al. ..... 523/336
4,417,992 A 11/1983 Bhattachryya et al. ..... 252/88
4,424,194 A 1/1984 Hughes ..... 423/27
4,431,614 A * 2/1984 Makipirtti et al. ..... 423/29
4,448,886 A 5/1984 Gestaut ..... 423/22
4,497,778 A 2/1985 Pooley ..... 423/27
4,526,615 A 7/1985 Johnson ..... 423/27
4,557,905 A 12/1985 Sherman et al. ..... 423/27
4,557,909 A * 12/1985 Mair ..... 423/167
4,571,387 A 2/1986 Bruynesteyn et al. ..... 435/245
4,585,548 A 4/1986 Cadzow et al. ..... 209/5
4,626,279 A * 12/1986 Bjornberg et al. ..... 423/23
4,654,078 A 3/1987 Perez et al. ..... 423/33
4,657,946 A 4/1987 Rende et al. ..... 523/402
4,690,894 A 9/1987 Brierley et al. ..... 435/244
4,721,526 A 1/1988 Elmore et al. ..... 266/168
4,729,788 A 3/1988 Hutchins et al. ..... 423/27
4,731,114 A * 3/1988 Ramadorai et al. ..... 423/47
4,732,608 A 3/1988 Emmett ..... 423/22
4,740,243 A 4/1988 Krebs-Yuill et al. ..... 423/27
4,743,396 A 5/1988 Fong et al. ..... 252/313.1
4,751,259 A 6/1988 Roe et al. ..... 524/52
4,752,332 A 6/1988 Wu et al. ..... 423/27
4,765,827 A 8/1988 Clough et al. ..... 423/27
4,767,449 A 8/1988 Rosen et al. ..... 75/767
4,778,519 A 10/1988 Pesic ..... 75/118 R
4,789,481 A 12/1988 Brierley et al. ..... 210/661
4,801,329 A 1/1989 Clough et al. ..... 423/27
4,802,914 A 2/1989 Rosen et al. ..... 75/3
4,822,413 A 4/1989 Pooley et al. ..... 423/27
4,875,935 A 10/1989 Gross et al. ..... 423/27
4,888,293 A 12/1989 Hackl et al. ..... 423/29
4,898,611 A 2/1990 Gross ..... 423/27
4,898,827 A 2/1990 Brierley et al. ..... 435/244
4,902,345 A 2/1990 Ball et al. ..... 423/27
4,910,010 A 3/1990 Khalafalla ..... 423/508
4,919,715 A * 4/1990 Smith et al. ..... 423/29
4,960,461 A 10/1990 Esna-Ashari et al. ..... 423/27
4,961,777 A 10/1990 Perez et al.
4,968,008 A 11/1990 Emmett et al. ..... 266/168
4,987,081 A 1/1991 Hackl et al. ..... 435/262
4,992,179 A 2/1991 Brierley et al. ..... 210/661
5,004,786 A 4/1991 Fong et al. ..... 525/344
5,005,806 A 4/1991 Krauth ..... 266/101
5,006,320 A 4/1991 Reid et al. ..... 423/109
5,021,088 A 6/1991 Portier ..... 75/736
5,034,139 A 7/1991 Reid et al. ..... 252/8.512
5,074,909 A * 12/1991 Agar ..... 75/423
5,075,390 A 12/1991 Fong ..... 525/379
5,077,021 A 12/1991 Polizzotti ..... 423/27
5,077,022 A 12/1991 Polizzotti ..... 423/27
5,084,520 A 1/1992 Fong ..... 525/329.4
5,123,956 A * 6/1992 Fernandez et al. ..... 75/423
5,127,942 A 7/1992 Brierely et al. ..... 75/743
5,152,969 A 10/1992 Kleid et al. ..... 423/DIG. 17
5,162,105 A 11/1992 Kleid et al. ..... 423/DIG. 17
5,196,052 A 3/1993 Gross et al. ..... 423/DIG. 17
5,244,493 A 9/1993 Brierely et al. ..... 75/743
5,246,486 A 9/1993 Brierley et al. ..... 423/27
5,252,003 A * 10/1993 McGahan ..... 423/87
5,254,320 A * 10/1993 Malmstrom ..... 423/29
5,332,559 A 7/1994 Brierley et al. ..... 423/27

OTHER PUBLICATIONS

Hagni et al., "Process Mineralogy of Roasted Pyrite and Arsenopyrite", *1992 Review of Extractive Metallury: Journal of Metal,* pp. 36–38, no month.

Hagni et al., "Mineralogy and Textural Characterization of Lime Roasted Pyrite and Arsenopyrite for Gold Leaching", *EPD Congress 1993: Edited by J.P. Hager,* pp. 393–401, 1992, no month.

Taylor et al., "Lime Roasting of Pyrite", *Gold '90: Proceedings of Gold '90 Symposium, Salt Lake City, Utah,* pp. 411–417, no month.

*Chemical Engineering,* ". . . and a Roasting Method for Gold", p. 23, "Apr., 1991".

Taylor et al., "Lime Roasting of Refractory Precious Metal Ores", *EPD Congress Proceedings from '91 Symposium,* New Orleans, LA, pp. 725–743, Feb., 1991.

Ahonen, L. et al., *Catalytic Effects of Silver in the Microbiological Leaching . . . ,* Hydrometallurgy, 24, (1990), Elsevier Science Publ., pp. 219–236 (no month).

Andrews, A., *Large–Scale Bioprocessing of Solids,* Biotechnology Progress, vol. 6, pp. 225–230, 1990 (no month).

Attia, Y.A. et al., *Effects of galvanic interactions of sulfides on extraction of precious metals from refractory complex sulfides by bioleaching,* International Journal of Mineral Processing, 30 (1990), Elsevier Science Publ. B.V., Amsterdam, pp. 99–111 (no month).

Baldi, F. et al., *Bioleaching of cobalt and zinc from pyrite ore in relation to calcitic gangue content,* World Journal of Microbiology and Biotechnology, 7, 298–308, 1991 (no month).

Ballester, A. et al., *The Influence of Various Ions . . . ,* Hydrometallurgy, 23 (1990), Elsevier Science Publ., pp. 221–235 (no month).

Bartlett, R.W., *Aeration Pretreatment of Low Grade Refractory Gold Ores,* Minerals and Metallurgical Processing, pp. 22–29 (Feb. 1990).

Bennett et al., *Limitations on Pyrite Oxidation Rates in Dumps Set by Air Transport Mechanisms,* Biohydrmetallurgy, Proceedings of Jackson Hole Symposium, Aug. 13–18, 1989 Canmet (1989).

Bhappu, R. et al., *Theoretical and Practical Studies on Dump Leaching,* Transactions vol. 244, Sep. 1969, pp. 307–320.

Bhattacharya, P. et al., *Reaction kinetics model for chalcopyrite . . . ,* Enzyme Microb. Technol. 1990, vol. 12, Nov., 1990, pp. 873–876.

Blancarte–Zurita, M.A. et al., *Particle Size Effects in the Microbiological Leaching . . . ,* Biotechnology and Bioengineering, vol. XXVIII, pp. 751–755 (1986) (no month).

Braddock, J. F. et al., *Growth Kinetics of Thiobacillus . . . ,* Applied and Environment Microbiology, Jul., 1984, vol. 48, No. 1, p. 48–55.

Braun, R.L., et al., *In–Place Leaching of Primary Sulfide Ores: . . . ,* Solution Mining Symposium, 1974, Aplan, F.F. et al., (eds.) Chapter 21 Proceedings of Symposium 103 AIME Annual Meeting Dallas, TX Feb. 25–27, 1974, pp. 295–323.

Brierley et al., *Enhanced Recovery of Gold from a Refractory Sulfidic–Carbonaceous Ore,* Proceeding Gold '90 Symposium in Salt Lake City, Utah, Feb. 26 to Mar. 1, 1990.

Brierly, Corale, et al., *Metal–tolerant Micro–organisms of Hot, Acid Environments,* G.W. Gould and J.E.L. Corry (eds.) 1980, Microbial Growth and Survival in Extremes of Environment. Society for Applied Bacteriology Tech. Series 15. Academic Press, London, pp. 39–51 (no month).

Brierley, J.A., *Thermophilic Iron–Oxidizing Bacteria . . . ,* Applied and Environment Microbiology, vol. 36, No. 3., Sep., 1978, pp. 523–525.

Brierley, James A. et al., *Microbial Mining Using Thermophilic Microoganisms,* ed. Thomas D. Brock, John Wiley & Sons, Inc., Ch. 12, 1986, pp. 280–305 (no month).

Brierley, James A., *Biotechnology for the Extractive Metals Industries,* J. of the Minerals, Metals & Materials Society, vol. 42, No. 1, Jan., 1990, pp. 28–30.

Brierley, James, A., *Acidophilic thermophilic archaebacteria: potential application for metals recovery,* FEMS Mircrobiology Reviews 75 (1990) pp. 287–292 (no month).

Brierley, James, A., *Use of Microorganisms for Mining Metals,* eds. Halvorson, H. et al., Engineered Organisms in the Environment: Scientific Issues, Proceedings of a Cross–Disciplinary Symposium Held in Philadelphia, PA, Jun. 10–13, 1985.

Bruynesteyn, A. et al., *Microbiological leaching of sulphide concentrates,* Canadian Metallurgical Quarterly, vol. 10, No. 1, 57–63 (no date).

Bruynsteyn, A. et al., *The BiotankLeach Process* Gold 100, Proceedings of the International Conference on Gold, vol. 2: Extractive Metallurgy of Gold, Johannesburg, SAIMM, 1986 (no month).

Budden, J. et al., *Considerations in the Monitoring of a Moderately Thermophilic Culture in the Oxidation of Refractory Gold Ores and Concentrates,* The Minerals, Metals & Materials Society, 1990, 315–322 (no month).

Burbank et al., *Biooxidation of Refractory Gold Ore in Heaps,* Proceedings Gold Tech 4, Reno, Nevada, Sep. 10–12, 1990, Ch. 16, pp. 151–159.

Bulter, B.J. et al., *Effect of Particle Size and pH on the Removal of Pyrite From Coal by Conditioning with Bacteria Followed by Oil Agglomeration,* Hydrometallurgy, 15, (1986), 325–336, Elsevier Science Publ. B.V. Amsterdam (no month).

Carranza, F., et al., *Selective Bioleaching . . . ,* Hydrometallurgy, 24, (1990) Elsevier Science Publ., pp. 67–76 (no month).

Chamberlin, P.D., *Agglomeration: Cheap insurance for good recovery when heap leaching gold and silver ores,* Mining Engineering, Dec., 1986, pp. 1105–1109.

Chander, S. et al., *Kinetics of Pyrite Oxidation,* Society of Mining Engineers, for presentation at the SEM–AIME Annual Meeting Denver, CO Feb. 23–27, 1987 (Preprint No. 87–150), pp. 1–7.

Chaudhury, Roy, G. et al., *Utilisation of Low–Grade Pyrites . . .* International Journal of Mineral Processing, 26 (1989), pp. 275–284 (no month).

Colmer, A. et al., *The Role of Microorganisms in Acid Mine Drainage: . . .* Science, Sep. 19, 1947, pp. 253–256.

Crundwell, F.K., *The influence of the electronic structure of solids on the anodic dissolution and leaching of semiconducting sulphide minerals,* Hydrometallurgy, 21, (1988), 155–190 (no month).

Datta, T.K., et al., *Technical Note Pretreatment of Chalcopyrite ore . . . ,* Minerals Engineering, vol. 3, No. 6, 1990, pp. 641–644 (no month).

Davis, G.B. et al., *A model of oxidation in pyritic mine wastes: part 1 equations and approximate solution,* Appl. Math. Modelling, vol. 10, Oct., 1986, 314–322.

Debus, Keith, *Mining with Microbes,* Technology Review, Aug./Sep. 1990, pp. 51–57.

Deepak, D. et al., *Bioleaching of Cooper from a Low–grade Chalcopyrite Ore,* J. Chem. Tech. Biotechnol. (1981), vol. 31, No. 6, pp. 358–362.

Dempsey, P. et al., *Bacterial Oxidation at Veal Reefs,* International Deep Mining Conference: Innovation in Metallurgical Plant, Johannesburg (SAIMM), (1990) 111–123 (no month).

Deter, K.W., "Oxygen Whole Ore Roasting at Jerritt Canyon Joint Venture" 1991 SME Annual Meeting, Denver, CO Feb. 25–28, 1991, Preprint No. 91–112, p. 1–5.

Dix, R.B., *Laboratory Heap Leach Testing: How Small and Large Scale Tests Compare,* Mining Engineering, Jun., 1989, pp. 440–442.

Duncan, D.W., *Biological Leaching of Mill Products,* Joint Meeting of the B.C. Section and Merrit Branch, C.I.M., Merrit, B.C. Oct., 1965, Transactions, vol. LXIX, 1966, pp. 329–333.

Dutrizac, J.E. et al., *Ferric Ion as a Leaching Medium,* Minerals Sci. Engng. vol. 6, No. 2, Apr., 1974 pp. 59–100.

Dutrizac, J.E. et al., *Percolation Leaching of Pentlandite Ore.* Can. Min. & Met. (CIM Bulletin) Mar., 1974. vol. 67., 169–175.

Foo K.A. et al., *Oxygen Utilization in Emerging Refractory Gold Ore Processes,* Gold & Silver Recovery Innovations, Sacramento, CA Randol, Nov. 10–11, 1989, pp. 47–51.

Ghiani, M. et al., *Use of Bacteria in Mineral Processing,* Society of Mining Engineers, Cagliari University, Cagliari, Italy, for presentation at SME Annual Meeting Denver, CO, Feb. 24–27, 1987 (Preprint No 87–18), pp. 1–8.

Gilbert, S.R. et al., *Comparative economics of bacterial oxidation and roasting as a pre–treatment step for gold recovery from an auriferous pyrite concentrate,* CIM Bulletin, vol. 81, No. 910, Feb., 1988, pp. 89–94.

Greene, John W., *Microbial Column Leaching of a Refactory, Carbonaceous Gold Ore,* Randol Gold Form '90 , Squaw Valley, California, Sep. 13–15, 1990, pp. 89–92.

Guay, R. et al., *Ferrous Iron Oxidation and Uranium Extraction . . . ,* Biotechnology and Bioengineering, vol. XIX, pp. 727–740 (1977) (no month).

Guedes de Carvalho, R.A. et al., *Bioleaching of Tungsten Ores,* Hydrometallurgy, 24, (1990), Elsevier Science Publishers BV Amsterdam, pp. 263–267 (no month).

Hackl, Ralph, P., *Operating a commerical–scale bioleach reactor at the Congress gold property,* Mining Engineering, Dec., 1990, pp. 1325–1326.

Hackl, Ralph P., *Operation of a commerical–scale bioleach reactor at the Congress gold property,* Advances in Gold and Silver Processing, Proceedings of the Symposium at GOLD-Tech 4, Reno, NV Sep. 10–12, 1990.

Hackl, Ralph et al., *Scaleup Experiences in Bio–oxidation of Refractory Gold Ores and Concentrates,* Gold & Silver Recovery Innovations, Randol, Sacramento, CA Nov. 10–11, 1989.

Hackl, R., *What to be Aware of in Cyanidation of Bio–Oxidized Products,* Gold & Silver Recovery Innovations, Sacramento, CA Randol, Nov. 10–11, 1989, pp. 143–144.

Haines, A.K. et al., *Process and Engineering Challenges in the Treatment of Refractory Gold Ores,* Keynote Address, International Deep Mining Conference: Innovations in Metallurgical Plant, Johannesburg, SAIMM (1990) pp. 103–110 (no month).

Hansford, G.S., et al., *The Logistic Equation for Modelling . . . ,* Minerals Engineering, vol. 5, No. 10–12, pp. 1355–1364, 1992 (no month).

Hanson, James S., *Kinetic model of the bacterial leaching of chalcopyrite concentrates,* Biotechnology in Minerals and Metal Processing, Department of Materials Science and Mineral Engineering, University of California at Berkeley, Berkeley, CA, Chapter 4, 25–31, no date.

Holmes, D.S., *Biotechnology in the mining and metal processing industries: challenges and opportunities,* Minerals and Metallurgical Processing, May, 1988, pp. 49–56.

Huber, Harold et al., *Thiobacillus cuprinus sp. nov., . . . ,* Applied and Environmental Microbiology, Feb., 1990, vol. 56, No. 2, pp. 315–322.

Hutchins, S.R. et al., *Microorganisms in Reclamation of Metals,* Ann. Rev. Microbiol. 1986, 40:311–336 (no month).

Hutchins, S.R., Brierley, J.A., and Brierley, C.L. *Microbial Pretreatment of Refractory Sulfide and Carbonaceous Ores Improves the Economics of Gold Recovery,* "Mining Engineering", Apr., 1988, pp. 249–254.

Ivanov, V.N. et al., *Effect of Ferric Ions on Oxidation of Ferrous Oxide by Thiobacillus ferrooxidans,* Plenum Publishing, 1988, D.K. Zabolotnyi Institute of Microbiology and Virology, Academy of Sciences of the Ukrainian SSR, Kiev. Translated from Mikrobiologiya vol. 56, No. 6, pp. 724–728, Nov.–Dec., 1987. (no month).

Jyothi, N. et al., *Electrochemical Aspects of Selective Bioleaching . . . ,* International Journal of Mineral Processing, 27, (1989), Elsevier Science Publishers BV Amsterdam., pp. 189–203. (no month).

K. Gooding, *Miners Bitten by the Gold Bug,* Technology, Jan. 11, 1994.

Karabelas, Anastasius J., *Use of asymptotic relations to correlate mass transfer data in packed beds,* Chemical Engineering Science, 1971, 26, 1581–1589 (no month).

Kasich, D., "Independence, Champions Whole Ore Roasters" *Mining World News,* Jan./Feb., 1991.

Komnitsas, C. et al., *Bacterial Oxidation of an Arsenical Gold Sulphide Concentrate from Olympias, Greece,* Minerals Engineering, vol. 3, No. 3/4, pp. 295–306, 1990 (no month).

Kontopoulos et al., *Process Options for Refractory Sulfide Gold Ores: Technical, Environmental, and Economic Aspects,* Proceedings EPO '90 Congress, D.R. Gaskell, Editor, The Minerals, Metals & Materials Society, 1990, no month.

Kurtz, Jeffrey P., et al., *Clay Problems Encountered in Gold Heap Leaching,* Manuscript submitted to Society of Mining Engineers for the Symposium on "Small Mines Development in Precious Metals" Aug. 30–Sep. 2, 1987, Reno, NV, pp. 1–17.

Larsson, Liselotte et al., *Pyrite Oxidation by Thermophilic Archaebacteria,* Applied and Environmental Microbiology, Mar., 1990, vol. 56, No. 3, pp. 697–701.

Lastra, R., *Mineralogical Examination of the Bacterial Leaching Progress on Base–Metal Sulphide,* Society for Mining, Metallurgy, and Exploration, Inc. for presentation at 1991 SME Annual Meeting, Denver, CO Feb. 25–28, 1991 (Preprint No. 91–57) pp. 1–6.

Lawrence, R.W., *The Potential of Thermophilic Bacteria in the Pretreatment of Refractory Gold Ores,* Annual Meeting of Biominet, Laurentian University, Sudbury, Ontario, Canada, Nov. 3, 1987.

Lawrence, R.W. and Marchant, P.B. *Biochemical Pretreatment in Arsenical Gold Ore Processing,* Arsenic Metallurgy Fundamentals and Application, Reno, Nevada, Jan., 1988, pp. 199–211.

Lawrence, Richard W., Editor, *Fundamental and Applied Biohydrometallurgy,* E. Livesey–Goldblatt, *Bacterial Leaching of Gold, Uranium, Pyrite Bearing Compacted Mine Tailing Slime,* Sixth International Symposium on Biohydrometallurgy, Vancouver, B.C., Canada, Aug. 21–24, 1985 pp. 89–96.

Lawrence, W.R., *Heap Leaching of Gold Ores,* An Investor's Guide to the Mining Industry, Mar. 4, 1991, pp. 1–9.

Lawson, E.N., Taylor, J.L. and Hulse, G.A. *Biological Pre–treatment for the Recovery of Gold from Slimes Dams,* Journal of the South African Institute of Mining and Metallurgy, Feb., 1990, pp. 45–49.

Lizama, Hector M., et al., *Bacterial Leaching of a Sulfide Ore . . . ,* Hydrometallurgy, 22 (1989) Elsevier Science Publishers B.V., Amsterdam, pp. 301–310 (no month).

Lizama, Hector M., et al., *Rate Equations and Kinetic Parameters . . . ,* Applied and Environmental Microbiology, Nov., 1989, p. vol. 55, No. 11, pp. 2918–2923.

Marchant, Brad A., *Cost Benefit Considerations for Innovative Applications of Biohydrometallurgy,* Gold & Silver Recovery Innovations, Sacramento, CA Randol, Nov. 10–11, 1989, pp. 115–121.

Marias, H.J., *Bacterial Oxidation of Arseno–Pyritic Refractory Gold Ore: Barberton Mines' Answer to Pollution Control,* International Deep Mining Conference: Innovations in Metallurgical Plant. Johannesburg, SAIMM, 1990, pp. 125–129 (no month).

McClelland, G.E. et al., *Agglomeration and Heap Leaching of Finely Ground Precious–Metal–Bearing Trailings,* U.S. Dept. of the Interior, Bureau of Mines, Information Circular 9034, U.S.GPO: 1985–505–019/20,084 (1985) (no month).

Mihaylov, B.V. et al., *Biooxydation of a Sulfide Gold Ore in Columns,* Mineral Bioprocessing, Proceedings of the conference Mineral Bioprocessing held in Santa Barbara, CA Jun. 16–22, 1991, ed. Smith et al., pp. 163–177.

Miller, Tim, *Bio–Oxydation of Heap Leach Grade Sulfide Ore at Mesquite,* Presented to NMA/UMA Symposium, Sep. 6, 1988.

Moffat, A.S., *Microbial Mining Boosts the Environment, Bottom Line,* Science vol. 264, May 6, 1994, p. 778–9.
Murr. L.E., *Theory and Practice of Copper Sulphide Leaching in Dumps and In–Situ,* Minerals Sci. Engng., vol. 12, No. 3, Jul., 1980 pp. 121–190.
Murthy, D.S.R., *Microbially enhanced thiourea leaching of gold and silver from lead–zinc sulphide flotation tailings,* Hydrometallurgy, 25 (1990) pp. 51–60 (no month).
Neeling, G. et al., *Enhanced Gold Extraction by Bio–Oxidation,* Gold & Silver Recovery Innovations, Phase IV Workshop, Sacramento, CA, Nov. 10–11, 1989, pp. 347–348 arranged by Randol International, Ltd.
Neuburg, H.J. et al., *A model for the bacterial leaching of copper sulfide ores in pilot–scale columns,* International Journal of Mineral Processing, 31, (1991), pp. 247–264, Elsevier Science Publ. BV Amsterdam.
Norris, P.R., *Dissolution of Pyrite . . . ,* FEMS Microbology Letters 4, (1978), pp. 143–146 (no month).
Okereke, A. et al., *Kinetics of Iron Oxidation by Thiobacillus ferroxidans,* Applied and Environmental Microbiology, vol. 57, No. 4, Apr., 1991, pp. 1052–1056.
Ollivier, P. et al., *Gold Liberation and Environmental Aspects of Bio–Oxydation Treatment of Refractory Gold Ores,* SME Annual Meeting, Salt Lake City, Utah Feb. 26–Mar. 1, 1990 pp. 1–9.
Olson, G. et al., *Rate of Pyrite Bioleaching by Thiobacillus ferrooxidans: Results of an Interlaboratory Comparison,* Applied and Environmental Microbiology, vol. 57, No. 3, Mar., 1991, pp. 642–644.
Palencia, I. et al., *The Electrochemical Behavior of a Semiconducting Natural Pyrite in the Presence of Bacteria,* Matallurgical Transactions B, vol. 22B, Dec., 1991, pp. 765–774.
Parkinson, Gerald, *Metals recovery makes big splash in Canada,* Chemical Engineering, Sep. 30, 1985, pp. 19–24.
Phariss, Ed et al., *Particle Agglomeration and Heap Leaching: A New Technology for Processing Low–Grade Gold and Silver Ore,* Engineering Bulletin 59/ Apr., 1982, pp. 33–38.
Pooley, F.D., *Use of Bacteria to Enhance Recovery of Gold From Refractory Ores,* Dept of Mining, Geological & Minerals Engineering, University College Cardiff, International Symposium Innovative Plant and Processes for Minerals Engineering, Minprep 1987, pp. 1–16 (no month).
Razzell, W.E., et al., *Isolation and Properties of an Iron–Oxidizing Thiobacillus,* J. Bacteriol., vol. 85, pp. 595–603. Mar., 1963.
Riley, R.P. et al., *Development of the VELMIX Bio–Oxidation Reactor,* International Deep Mining Conference: Innovations in Metallurgical Plant, Johannesburg, SAIMM, (1990) pp. 131–140 (no month).
Sand, Wolfgang, *Ferric iron reduction by Thiobacillus ferrooxidans . . . ,* Biogechemistry, 7: 195–201 (1989), no month.
Sitarski, John, et al., *Bioleaching: Bioreactor Design Issues,* Gold & Silver Recovery Innovations, Sacramento, CA Randol, Nov. 10–11, 1989, pp. 145–147.
Sohn, H.Y. & Wadsworth, M.E., *Rate Process of Extractive Metallurgy,* Plenum Press, New York, 191–197 (1979) (no month).
Spencer et al. *Metallurgical Considerations . . . ,* Gaskell (ed.), EPD Congress '90, Proceedings of a symposium sponsored by the Extraction and Processing Division, and held at the TMS Annual Meeting in Anaheim, CA Feb. 19–22, 1990, pp. 295–303.
Suttill, Keith, R. *Bio–Oxydation for Refractory Gold: Bio–Oxydation comes one step closer to full–scale commerical operation,* vol. 190, E&MJ, Sep., 1989, pp. 31–32.
Suzuki, I., *Competitive Inhibition of Ferrous Iron . . . ,* Applied and Environmental Microbiology, May, 1989, vol. 55, No. 5., pp. 1117–1121.
Taylor, J.H. et al., *The Leaching of Cupreous Pyrites and the Precipitation of Copper at Rio Tinto, Spain,* Bull. The Inst. of Mining & Metallurgy, No. 457, Nov., 1942, pp. 1–36.
Tsuchiya et al., *Microbial Mutualism in Ore Leaching,* Biotechnology and Bioengineering vol. XVI, (1974), pp. 991–995 (no month).
Tuovinen, O.H. et al., *Mixed Cultures in Biological Leaching Processes . . . ,* Chapter 13, Zeikus, J.G. et al. (eds.), McGraw–Hill, New York, 1991, pp. 373–427 (no month).
Tuovinen, O.H. et al., *Use of Micro–Organisms for the Recovery of Metals,* International Metallurgical Reviews, vol. 19, 1974, pp. 21–31 (no month).
van Aswegan, P.C., et al., *Developments and Innovations in Bacterial Oxidation of Refractory Ores,* for presentation at 1991 SME Annual Meeting, Denver, CO Feb. 25–28, 1991, 1–12.
Vargas, T. et al., *The Catalytic Role of Thiobacillus Ferrooxidans in the Leaching of Pure Natural Chalcopyrite,* Gaskell, D.R.(ed.) EPD Congress, Proceedings of a symposium sponsored by the Extraction and Processing Division, TMS Annual Meeting Anaheim, CA Feb. 19–22, 1990.
von Michaelis, Hans, *Innovative Refractory Ore Treatment Processes,* Gold & Silver Recovery Innovations, Sacramento, CA Randol, Nov. 10–11, 1989, pp. 39–46.
White, Lane, *Treating refractory gold ores,* Mining Engineering, Feb., 1990, pp. 168–174.
Yopps, D.L., et al., *Recovering Platinum Group Metals from Stillwater Complex Flotation Concentrate by Bioleaching,* Reno Research Center, U.S. Bureau of Mines, Reno, NV., Preprinting at the 1991 SME Annual Meeting, Biotechnology in Mineral Processing Session, Denver, CO, Feb. 25–28, 1991 and preprinting at the 1991 TMS Annual Meeting New Orleans, LA, Feb. 17–21, 1991.

* cited by examiner

PROCESS FOR TREATING ORE HAVING RECOVERABLE METAL VALUES INCLUDING ARSENIC CONTAINING COMPONENTS

This application is a continuation-in-part, continuation division of application Ser. No. 07/864,241, filed Apr. 10, 1992, abandoned, which is continuation-in-part of application Ser. No. 07/684,649, filed Apr. 12, 1991, now U.S. Pat. No. 5,123,956 granted Jun. 23, 1993.

BACKGROUND OF THE INVENTION

1. Technical Field of the Invention

This invention relates to recovering precious metal and/or metal values from ores including refractory ores, ore concentrates, or ore tailing which include arsenic-, carbon- and/or sulfur-containing components and ores which are refractory to the recovery of precious metal values.

2. Background Art

Precious metals, such as gold, occur naturally in ores in different forms. Unfortunately, precious metal ores also frequently contain other materials which interfere with the recovery of these precious metal values, rendering these ores refractory to precious metal recovery. Furthermore, the precious metal content may be at a relatively low level. This low level content compounds the effect of the refractory nature of these ores.

The following patents are illustrative of attempts to deal with refractory components in precious metals and other metals recovery as well as efforts in distinctly different fields addressed to solving the arsenic contamination problems encountered when roasting precious metal and other metal ores having arsenic as an unwanted component present in the ore.

U.S. Pat. No. 360,904 to Elizabeth B. Parnell relates to roasting gold or silver bearing ores using a double roasting schedule with the first roasting at 1100 to 1300 degrees Fahrenheit and the second roasting to 1200° F. to 1600° F. (the time occupied in the second roasting can be reduced by supplying oxygen along with the air).

U.S. Pat. No. 921,645 to J. E. Greenwalt discloses the roasting of ore by heating the ore on a porous granular bed through which air is forced from below.

U.S. Pat. No. 1,075,011 to N. C. Christensen, Jr. discloses a process for treating ore by means of a roasting oven which, by regulation of the fuel supply, may be either oxidizing, reducing, or neutral.

U.S. Pat. No. 2,056,564 to Bernart M. Carter discloses suspension roasting of finely divided sulfide ores. Roasting is in air or oxygen in which the temperature of the mixture entering the roasting chamber is controlled and to a corresponding degree the temperatures within the roasting chamber are thus controlled in an effort to prevent the formation of accretions on the walls of the apparatus.

U.S. Pat. No. 2,209,331 to Ture Robert Haglund discloses a process for the production of sulfur from the roasting of sulfide material in oxygen or air enriched with oxygen so that as soon as the free oxygen has been consumed in the formation of $SO_2$, the iron sulfide reacts with the sulfur dioxide forming free sulfur and iron oxides.

U.S. Pat. No. 2,536,952 to Kenneth D. McCean relates to roasting mineral sulfides in gaseous suspension.

U.S. Pat. No. 2,596,580 to James B. McKay et al. and U.S. Pat. No. 2,650,159 to Donald T. Tarr, Jr. et al., relates to roasting gold-bearing ores which contain commercially significant amounts of gold in association with the mineral arsenopyrite. The patent describes the importance of closely regulating the availability of oxygen in order to provide enough oxygen so that volatile compounds of arsenic are formed while the formation of nonvolatile arsenic compounds is minimized.

U.S. Pat. No. 2,867,529 to Frank A. Forward relates to treatment of refractory ores and concentrates which contain at least one precious metal, sulfur and at least one arsenic, antimony or lead compound by roasting in a non-oxidizing atmosphere at a temperature above 900 degrees Fahrenheit, but less than the fusion temperature of the material being roasted.

U.S. Pat. No. 2,927,017 to Orrin F. Marvin relates to a method for refining metals, including precious metals, from complex ores which contain two or more metal values in chemical union or in such physical union as to prevent normal mechanical separation of the values. The method uses multiple roasting steps.

U.S. Pat. No. 2,993,778 to Adolf Johannsen et al. relates to roasting a sulfur mineral with its objects being-the production of sulfur dioxide, increasing the completeness of roasting and the production of metal oxides.

U.S. Pat. No. 3,172,755 to Angel Vian-Ortuno et al. relates to a process for treating pyrite ores bearing arsenic by subjecting the arsenic-containing pyrite ore to partial oxidation so as to oxidize only the labile sulfur of the arsenic-containing pyrite and subsequently heating the pyrite ore in a non-oxidizing gas to separate the arsenic from the ore and to form a residual ore free of arsenic.

U.S. Pat. No. 4,731,114 Gopalan Ramadorai et al. relates to a process for the recovery of precious metals from low-grade carbonaceous sulfide ores using partial roasting of the ores following by aqueous oxidation in an autoclave.

U.S. Pat. No. 4,919,715 relates to the use of pure oxygen in roasting of refractory gold-bearing ores at temperatures between about 1000° F. (537.8° C.) and about 1200° F. (648.9° C.). This patent fails to address the problem of arsenic volatilization, is silent on the arsenic content in the ore, and does not address in that context the optimizing of gold recovery from refractory sulfidic, carbonaceous ores or separation of cyanide consuming components before recovery of gold from the ore. The disclosed method requires two fluid beds and stage-wise roasting in these beds and the use of substantially pure oxygen (substantially pure oxygen being defined as at least about 80% by weight.)

European Patent Specification 0 128 887 discloses roasting sulfide concentrates having an average particle size below 1 mm and containing copper and noble metals as valuable metals as well as arsenic as an impurity. Volatization of arsenic is in a circulating fluidized bed under an oxygen partial pressure of $10^{-14}$ to $10^{-16}$bars and at low temperatures, i.e. temperatures which exceed the breakdown and decomposition temperatures of arsenic compounds. A major part of the solids is removed under the same conditions in a hot cyclone from the suspension discharged from the fluidized bed reactor and is recycled to the fluidized bed reactor. Additional solids are removed from the gas in a second cyclone. After an optional fine purification in an electrostatic precipitator the exhaust gas is discharged through a chimney. The calcine from the circulating fluidized bed and eventually solids collected in the second cyclone are fed to a classical fluidized bed, in which the sulfur containing materials which are present are roasted at an increased oxygen potential. In the event the temperature falls below the sublimation temperature of the arsenic oxides contained in the exhaust gas from the circulating fluidized bed, arsenic oxides may be removed together with the residual solids. That exhaust gas may also contain volatilized sulfur.

German Patent Specification 15 83 184 discloses the removal of arsenic from iron ores and calcined pyrites in a process in which the ores are mixed with calcium oxide or calcium carbonate in an amount of 0.5% to 5% as Ca relative to the weight of the ore and are heated in an oxidizing atmosphere to 800° C. to 1000° C. so that the arsenic is concentrated in a fine-grained fraction. This fraction is separated from the coarser fraction and is leached with acids to remove arsenic. In this patent, in the description of the state of the art in the roasting of pyrites, an addition is described of oxides, hydroxides and various salts of alkali metals and alkaline earth metals. From these additives, corresponding water-soluble arsenates may be formed from the arsenic contained in the ore. The effect of these additives in the roasting stage is constrained by the formation of the corresponding sulfates. The sulfates are almost entirely inactive in a reaction for partitioning arsenic. When the above substances are added to calcined pyrites in an oxidizing atmosphere at 500° C. to 900° C., arsenates will be formed, which may be leached with salt solutions or acid solution. These arsenates should not be dumped in open air dumps. Moreover, the leaching results in an arsenic-containing solution, which is nearly impossible to dispose environmentally in an acceptable manner.

For sulfide ores, any arsenic which is present is an undesired accompanying element and must be removed from the calcine and from the roaster gas. This is typically accomplished by a so-called dearsenication roasting. The arsenic content of the material is volatilized in a roasting zone having a low oxygen content and enters the gaseous effluent as arsenic vapor or arsenic oxide vapor and arsenic sulfide vapor. The above mentioned U.S. Patent art deals with such roasting. In the gaseous effluent, arsenic and arsenic sulfides are oxidized to form arsenic oxide vapors under a relatively high oxygen partial pressure.

However, a number of problems are encountered. The dustlike solids contained in the roaster gas are removed at a temperature exceeding the sublimation temperature of the arsenic oxides, which are subsequently separated at lower gas temperatures, or the solids and the arsenic oxides are jointly removed at lower gas temperatures. In the first case, contaminated arsenic oxides will be formed. In the second case, the arsenic which has been removed will be recycled in the process scheme. Recycling is together with the other solids which have been separated, particularly if the solids contain valuable metals and for that reason alone must be recirculated, or the removed solids may be dumped only after taking special precautionary measures because of the arsenic content. In the second case there is also a risk that part of the arsenic oxide may undesirably and unpredictably react with metal oxides to form metal arsenates, e.g., with $Fe_2O_3$ to form $FeA_3O_4$. The metal arsenates deposit on the ore particle surfaces and clog the pores of the particle.

Particularly in the roasting of gold ores, the formation of $FeAsO_4$ on the particle surfaces will involve a higher cyanide consumption in the leaching and a lower yield of gold.

German Patent Specification 1,132,942 disclosed a process of roasting iron-containing sulfide ores, particularly pyrites in which the ores are roasted in a single stage fluidized bed roaster with oxygen-containing gases at 800° C. to 900° C. under an oxygen partial pressure not in excess of $2.9\times10^{-8}$ atm so that the iron content is reacted to form $Fe_3O_4$, some sulfur is sublimated and arsenic, arsenic sulfides and arsenic oxides are vaporized. Solids entrained by the roaster exhaust gas are subsequently removed at temperatures exceeding the condensation temperatures of sulfur and arsenic and the roaster gas is after-burned with a supply of air or oxygen so that the oxygen partial pressure is sufficiently increased to ensure a complete combustion of the sulfur in the purified roaster gas. The arsenic oxides produced by the after burning and removed from the gas stream, will be contaminated by residual dust.

German Patent Specification 1,458,744 discloses the roasting of iron sulfides by a process in which the ores are roasted in a single stage fluidized bed roaster with oxygen-containing gases at 700° C. to 1100° C. and under an oxygen partial pressure of about $10^{-2}$ to $10^{-15}$ atm, whereby $Fe_2O_3$ is partly formed, the arsenic which is present is substantially volatilized as $As_2O_3$ and the sulfur is volatilized as elementary sulfur. After the solids have been removed from the roaster gas, the oxygen partial pressure in the roaster gas is increased by a supply of air and the elementary sulfur and the arsenic compounds are oxidized. In that process too the volatile arsenic oxides are contaminated by residual dust as they are removed from the gas stream.

From German Patent Specification 30 033 635 it is known that arsenic-containing material, particularly non-ferrous metal ores, may be treated and the arsenic may be volatilized in a first stage at temperatures of 627° C. to 927° C. and under oxygen partial pressures of about $10^{-16}$ bars. The solids are roasted under oxidizing conditions in a second stage. The gas from the second stage is fed in part to a gas purifier and in part to the first stage. Sulfur and oxygen are added to the exhaust gas from the second stage and the arsenic contained therein is completely reacted to form arsenic sulfides, which are partly present as fine dust and partly as vapor. In a scrubber the vaporous arsenic sulfides are condensed and removed together with the solid arsenic sulfides. The arsenic sulfides which have been removed from the scrubbing water are dumped. The presence of $SO_2$ involves a risk of a formation of arsenic oxides, which must not be dumped because of their solubility. Besides, a high consumption of elementary sulfur is involved.

None of these patents teaches or suggests roasting ores or refractory ores, ore concentrates or ore tailings of the type described herein for recovery of metals such as precious metals in an oxygen-enriched gaseous environment under conditions as described herein in order to minimize and/or eliminate arsenic volatilization, facilitate arsenic conversion to an insoluble, environmentally acceptable form immobilized in a waste product while reducing the effects of carbon- and sulfur-containing components on metal recovery such as precious metal recovery. Moreover, none of the references deals with the conversion of arsenic to arsenates of environmentally very stable compounds during roasting e.g. a single stage circulating fluid bed roasting of ores. In fact, the opposite is true. The present invention achieves excellent results in a simpler more efficient manner with outstanding metal, e.g. gold recovery with facile arsenic elimination as an environmental problem, while minimizing leaching cyanide consumption and conserving heat given-off in the roasting process.

BRIEF DESCRIPTION OF THE INVENTION

Figure 1:
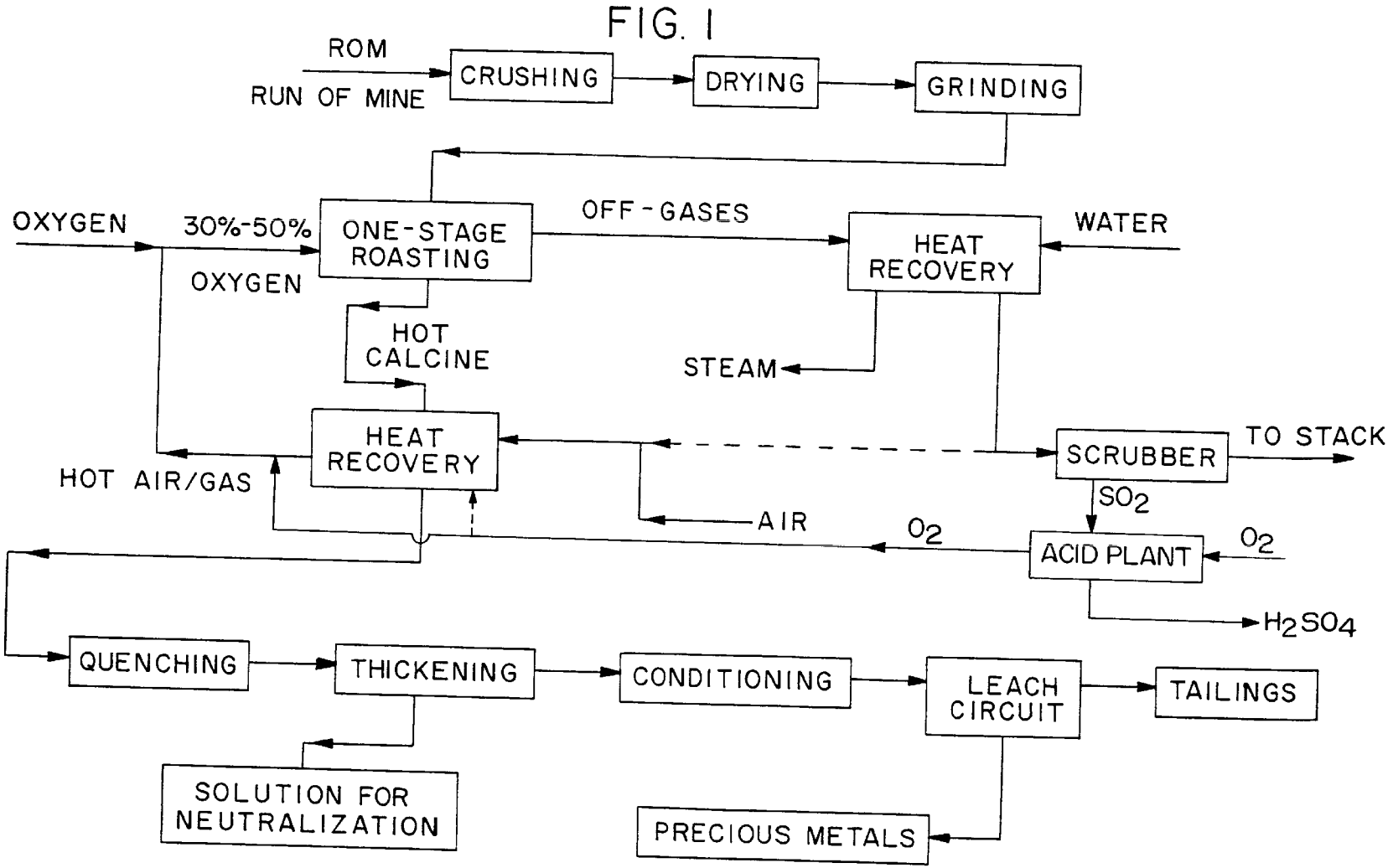
FIG. 1 is a flow diagram of the process of the present invention.

In accordance with the present invention precious metal and metal values may be recoverable from ore, ore concentrates or tailings which have arsenic- carbon- and sulfur-containing components by 1) comminuting the material to a desired particle size;
2) roasting the comminuted material under the conditions set forth herein which oxidizes, or burns off, the carbon and sulfur values and provides a calcined product amenable to efficient gold recovery; while
3) sequestering in and/or converting arsenic to an insoluble form during roasting of the comminuted material, and
4) leaching with increased efficiency the precious metal values from the roasted materials.

Hence, it is a desideratum to roast refractory gold ores in such a manner that cyanide leaching will result in a high yield of gold, will involve a low consumption of cyanide, and will assure economic environmentally acceptable disposal of arsenic-containing solids.

In accordance with the present invention, the above objective is accomplished by a process of roasting ores containing metal values or refractory gold ores or gold ore concentrates or tailings whereby the roasting is carried out:

a) at temperatures which are between 450° C. to 900° C. and below the temperature at which a molten phase of a roasted ore material is formed;
b) in an oxygen-containing atmosphere of at least 1% oxygen, on basis of volume, and referenced to a basis amount of oxygen in air;
c) in the presence of or with an addition of at least one or more substances of the group consisting of the free oxides, carbonates, sulfates, hydroxides, and chlorides of calcium, magnesium, iron and barium, or of pyrites, or iron in an amount which is in excess or the amount which is stoichiometrically required to form a stable arsenate preferably the substance is present in at least 1 to 4 times the stoichiometric amount necessary, on a mole basis, to react with the arsenic in the ore; and
d) in the presence of water vapor.

An $SO_2$-containing exhaust gas obtained in such reaction is thereafter purified, and may be sent to an acid plant producing sulfuric acid wherein surplus oxygen employed in such acid plant to obtain sulfuric acid is recirculated to an appropriate place in the process, e.g. circulating fluid bed or calcine coolers or ore heaters to utilize more efficiently in such combination oxygen employed in this process.

According to a preferred feature the oxygen content of the gas defined in b) amounts to 20% to 50% by volume; amounts as high as 65% by volume may be employed.

Other advantages of the present process will be further explained such as improved heat recovery, fast reaction rates, lowered emission of gases such as fluorine, etc.

Still further, this invention relates to a process of removing arsenic vapor and arsenic-compound vapor from dust-containing hot gases such as during ore roasting, wherein solids are separated from the gas at a temperature above the condensation temperature of the arsenic and arsenic compounds. These arsenic components are subsequently oxidized with a supply of oxygen-containing gases and immobilized for disposal in an environmentally acceptable manner meeting with ample margins of safety the acceptable environmental disposal requirements.

An another aspect of this invention and as a result of the novel manner of looking to solve the arsenic problem plaguing the industry, this invention is to provide an economic process by which the metallic arsenic and the arsenic compounds found with mineral values upon roasting and contained in the gases are converted to a form that these values may be dumped in an environmentally acceptable manner.

The above is accomplished, in accordance with the invention thusly:

i) solids are removed from the gas;
ii) one or more substances are added to the gas, these substances comprise the group consisting of the oxides, hydroxides, carbonates, and sulfates of iron, calcium, magnesium and barium or pyrites or iron ; moreover, these substances have a particle size below 3 mm;
iii) the gas and the added substances are treated in the presence of water vapor and at temperatures of about 300° C. to about 800° C. under oxidizing conditions in such a manner that the exhaust gas contains at least 1% oxygen and the arsenic content is reacted to form stable arsenates; and
iv) these stable arsenates are removed from the gas stream and carried away.

The arsenic compound vapors contained in the gas to be treated may consist of arsenic oxides and arsenic sulfides. The percentages are in percent in volume with reference to gases.

Depending on the source of the gas, it may be free of $SO_2$ or may contain $SO_2$. As discussed above, $SO_2$-containing gases are produced, e.g., by the roasting of sulfur-containing materials, such as sulfidic non-ferrous metal ores. $SO_2$-free gases are produced, e.g., by the thermal processing of arsenic-containing intermediate products and waste materials, such as sludges, dusts and solutions as it is known in the metallurgical industry. The solids are suitably removed from the gas in cyclones and/or ceramic filters, such as candle filters and/or hot electrostatic precipitators.

The above recited additives in ii) may consist of waste products, such as red mud formed by processes employed in the alumina production industry, filter salts and waste gypsum. Particularly suitable additives are sulfates, e.g. iron sulfates. The particle size of the additives should be as small as possible because small particles will reduce the reaction time and the amount of reactant which is required. The term "stable arsenates" designates those arsenates which have only a low solubility in rainwater. The additives are added in amounts which are sufficient for the formation of the arsenates. Preferably, the additives are present in at least 1 to 4 times the stoichiometric amount necessary, on a mole basis, to react with the arsenic in the ore. Mixtures of additive are also used. Water required for the water vapor content in the gas phase may be introduced into the gas to be treated by a corresponding supply of steam, as moisture or even as water of crystallization in the ore or additives. The arsenates are preferably formed at a temperature of 500° C. to 600° C. The maximum oxygen content of the exhaust gas is not critical and may be, e.g., 50% of volume. If the exhaust gas contains $SO_2$, it may be processed in a suitable plant for the production of sulfuric acid. The treatment may be effected in a circulating fluidized bed, an ebullating fluidized bed, a classical fluidized bed, a rotary kiln or a multiple-hearth furnace; a circulating fluidized bed is preferred.

The solubility of the stable arsenates is so low that these may be dumped without special precautionary measures.

According to a preferred feature at least 80% of the additives employed have a particle size of about 10 to about 200 $\mu$m. With that particle size a substantially complete and fast formation of arsenates will be effected.

According to a preferred feature the water vapor content of the exhaust gas is adjusted to 0.5% to 10%. This content will result in a formation of stable arsenates having a particularly low solubility, e.g. such as scorodites or scorodite like compounds.

According to a preferred feature, gases in which the dust has no content or only a low content of metal are treated to remove only that amount of solids which exceeds the amount of solids required to form arsenates. A typical example for such aspect of the invention is in the roasting of pyrites or calcined pyrites or in the processing of gases in which the dust content consists of iron compounds. It is possible to utilize at least a part of the additives for the reaction with a containing arsenic values and thus these additives need not be separately obtained and added.

According to another preferred feature, the solids suspended in the gas are substantially removed therefrom if the dust in the gas has a valuable metal, e.g. gold. In that case the valuable metal will substantially be introduced into the calcine and can be recovered therefrom. It will then be necessary to add the required additives in the necessary amount to immobilize the arsenic.

Refractory ores which include carbon-and sulfur-containing components, such as organic and inorganic carbonaceous materials and sulfidic minerals, respectively, pose an especially severe problem in the economical, commercial recovery of precious metals, such as gold, because the efficiency and completion of recovery is dependent on the content of those carbon- and sulfur-containing components. The recovery yield of precious metal values in refractory ores can be significantly increased by oxidizing carbon- and sulfur-containing components. The efficient oxidation of carbon is especially important because residual carbon in the roasted ore, or calcine, reduces precious metal recovery during leaching by "preg robbing" because it takes up or "robs" leachant solubilized gold.

However, refractory ores which further include arsenic-containing components pose an even more complex problem. This arsenic content, while amenable to oxidation as discussed above, poses a problem in that the arsenic component or an intermediate product of roasting may volatilize at roasting temperatures, thereby requiring supplemental precautionary processing measures or the oxidized end product in the calcine solubilizes to a presently unacceptable level during leaching and/or after the exhausted calcine, i.e. tailings have been discarded and stored in a heap.

The improved process specifically for precious metal recovery from these refractory ores or their concentrates or tailings may be practiced with improved yields. Thus, not only can improved yields be achieved in an economically efficient manner, but also the problem of arsenic volatilization can be controlled. Consequently, preferrably arsenic is immobilized in the calcine upon roasting but further roaster gas treatment such as in the fluidized bed(s) be practiced to immobilize arsenic in the event a gas phase treatment of the volatilized arsenic compounds is desired. As a side benefit, fluorine (while present in very small amounts in the form of HF) is also converted to an unknown insoluble form in the calcine such that only a small percentage must further be treated thereby reducing fluorine levels. On an elemental basis, the reduced HF and arsenic immobilization levels achieved by the present process are far below the present day required limits.

Furthermore, the lower temperatures and lower oxygen concentrations make the process more economically efficient. The process for the recovery of precious metals from refractory ores or their concentrates or tailings (here referred to generically for the sake of simplicity simply as "ore" or "ore material" or "ore particles") which include arsenic-, carbon- and sulfur-containing components according to the present invention includes roasting that ore in an oxygen-enriched gaseous atmosphere such as oxygen augmented air having an initial oxygen content of less than about 65 percent by volume and recovering the thus-roasted ore, whereby the ore is amenable to recovery of the precious metal values in it. In the event a reduced content oxygen atmosphere is used for a vaporized arsenic compound treatment in a gas phase, the specific steps will be discussed proceeding from the above base case as first disclosed in the continuation-in-part application, Ser. No. 07/684,649, filed Apr. 12, 1991 and now U.S. Pat. No. 5,123,956, granted Jun. 23, 1992.

The term "free oxides" in item c) above indicates that said substances are not present as compounds with arsenic or sulfur but in a form free of these. If calcium and magnesium as carbonates are available in a free form in the ore in a sufficient amount, it will be unnecessary to add said substances.

If iron compounds are present, even in a large excess, an addition will always be required, i.e. if below a ratio of 3.5 to 4.0 moles iron to a mole of arsenic, because a major part of the iron will always be included in compounds with arsenic or sulfur. Hence, iron must be present of at least 3.5 moles of iron for each mole of arsenic. The additives may consist of waste products, such as red mud from the alumina industry, filter salts and waste gypsum. Sulfates are particularly suitable. As seen from the data herein, iron compounds are preferred. The use of an additive is preferable because the additive, in particle form will then be present close to the ore particles and will be able to combine immediately with arsenic which may have been vaporized from the ore particles at the higher temperatures discussed herein.

The term "stable arsenates" designates those arsenates which have only a low solubility in rainwater when stored in a waste dump of an exhausted calcine. Proper roasting is also related to the iron content in the ore, e.g., as pyrites in the ore, the partition of arsenic between oxidation and reaction with an iron, or other compound in the ore, or an added additive and the role of iron in added form (if addition is necessary to the ore) the conversion of arsenic to scorodite or scorodite compounds during roasting and like effects.

The process of the present invention is preferably suitable for use on candidate precious metal ores having arsenic-, sulfur- and carbon-containing components. Typically, iron is in the form of the sulfides in such ores, i.e. pyrites.

Water required for the water vapor may be fed to the reactor by a suitable addition of steam, as moisture or water in the ore, of crystallization in the additives or as a water of crystallization in a component in the ore. Depending on the $SO_2$ content, the exhaust gas may be processed for a production of sulfuric acid or may be scrubbed to remove the $SO_2$ or the $SO_2$ content may be liquified.

Preferably, the ore is roasted in the form of fluidized solids, and more preferably, the ore circulates as fluidized solids in a circulating fluidized bed or in an ebullating fluidized bed (which has a circulation feature to it). The precious metal content can be recovered from the thus-roasted ore or ore concentrate or tailings by separation of cyanide consuming components by solubilization of these and then leaching through cyanidation, carbon-in-leach cyanidation or carbon-in-pulp cyanidation.

The advantage afforded by the process in accordance with this invention resides in that the calcine which is produced has a very good leachability, with e.g. cyanide, resulting in a high yield of gold and in a low consumption of cyanide. Moreover, the arsenic is bound in the form of stable arsenates, which do not disturb the leaching and which have an extremely low solubility in rainwater such that these calcines may be dumped without a need for special precautionary measures or further treatment(s).

The ores or concentrates may contain up to about 1% arsenic and even up to 2% and more. In addition to the roasting being effected in a circulating fluidized bed, a stationary fluidized bed having a defined upper surface may also be used. Further, an ebullating fluid bed, a rotary kiln or a multiple-hearth furnace, may be employed, provided the proper reactions may be obtained. The temperature at which an undesirable molten phase is formed depends on the composition of the ore in molten phase in or on the ore particle even a partial molten phase, e.g. partial sintering is undesirable as metal recovery by leaching is undesirably affected. The percentages for the gases are stated in percent by volume.

In the event of a low arsenic content in an ore, the gas which is fed is adjusted to have a higher oxygen content. The reaction temperature is achieved by a feeding of hot gases and/or by an addition of fuel. If fuel is added, oxygen in the amount required for the combustion of fuel must be added. If a reaction temperature is low, the required heat is introduced by feeding of suitable hot gases and/or by a sufficient preheating of the charged materials.

Roasting, with two stage oxygen injection may be carried out particularly conveniently. The roasting in the lower portion of the circulating fluid bed reactor is carried out as the first stage. A fluidizing gas contains an oxygen-containing atmosphere having an oxygen content below about 1%. The second oxygen injection during this roasting stage is carried out in the upper portion of the reactor with a supply of secondary gas and optionally even with a supply of tertiary gas having yet more oxygen injected in that phase at a corresponding higher oxygen content.

The candidate ores may have the following levels of arsenic, carbon and sulfur components on a percent by weight basis:

| | |
|---|---|
| Arsenic | up to 1.0% or higher |
| Carbon | 2.5% Maximum |
| Sulfur | 5.0% Maximum |

(All percentages are on a weight-to-weight basis unless otherwise stated.)

The ore is primarily pyritic-carbonaceous-siliceous. Candidate ores may be found in the region around Carlin, Nev. Other types of ores which may be used have been identified as siliceous-argillaceous-carbonate-pyritic, pyritic-siliceous, and carbonaceous-siliceous. Small amounts of dolomite, calcite and other carbonate materials may be present in the ore.

A typical mineralogical analysis of these ores shows:

| | |
|---|---|
| Quartz | 60–85 Percent |
| Pyrite | 1–10 Percent |
| Carbonate | 0–30 Percent |
| Kaolinite | 0–10 Percent |
| $Fe_xO_y$ | 0–5 Percent |
| Illite | 0–5 Percent |
| Alunite | 0–4 Percent |
| Barite | 0–4 Percent |

A typical chemical analysis of the ore shows an average composition as follows:

| | |
|---|---|
| Arsenic | 0.2 Percent |
| Sulfur (Total) | 4.0 Percent |
| Carbon (Total) | 1.0 Percent |
| Iron | 3.5 Percent |
| Zinc | 0.08 Percent |
| Strontium | 0.03 Percent |
| Gold | 0.15 Ounces per ton |

This ore, if so treated, typically shows gold recovery of less than 10 percent by simple cyanidation and less than 20 percent by simple carbon-in-leach cyanidation.

On the other hand, gold recovery by using the process of the present invention yields from about 75 percent to about 90 percent (and even higher) gold recovery.

While the primary application of the present invention relates to ores (as opposed to ore concentrates or tailings), it appears that ore concentrates may be used or that ore tailings may be used from the recovery of precious metal, or other values. The term "ore" as it is used throughout the remainder of this description encompasses and contemplates not only ores but also ore concentrates and ore tailings.

According to another feature of this invention, the roasting treatment according to items a) to d) described above is preceded by a first roasting stage, in which the roasting is effected at temperatures which are between 450° and 900° C., preferably below 575° C., and below the temperature at which a molten phase is formed of an ore material and in an oxygen-containing atmosphere having an oxygen content below 1%. Such roasting assures vaporization and an immediate reaction of the arsenic with the additive. At the second oxygen injection point, a roasting with two stage oxygen injection may be necessary if the ores contain more than about 1% arsenic but may also be adopted if the ores have a lower arsenic content and are particularly refractory. The additives according to c) and the water vapor according to d) need not be present in the first roasting stage but are preferably added already in the first roasting stage.

According to a preferred feature the water vapor content of the gas defined in d) ranges from about 0.5% to 10% by weight. Arsenates having a particularly low solubility such as scorodites will be formed if the water vapor content is in that range.

The advantages set forth herein-before will be achieved even with ores which contain about 1% to 2% arsenic if the roasting is effected by two stage oxygen injection. Roasting in two stages will produce particularly good results with ores which contain less than about 1% arsenic although equivalent results will also be obtained by proper use of arsenic immobilizing additives and oxygen content in the roasting gas.

According to a desired feature, provided that no molten phase forms on or within the ore particle, the roasting is effected at temperatures of 550° C. to 750° C. Thus, the formation of a molten phase may reliably be avoided, and the heat consumption may be low. The arsenic will effectively be bound and immobilized and the calcine will have a good leachability.

According to a preferred feature the substances defined in c) are present in at least about 1.5 to about 3 to 4 times the stoichiometric quantity depending on the particular compound and ore used. This will result in an effective binding of the arsenic in conjunction with a relatively small amount of solids. The amount of the substance added is, of course, determined by the solubility of arsenic in the exhausted calcine.

According to a preferred feature, the substances defined in c) are added in a particle size below 1 mm. That particle size will result in an effective contact and binding of arsenic present in the ore material.

According to a preferred feature 80% of the substances defined in c) are added in a particle size of 10 to 50 $\mu$m.

Arsenic will be bound very effectively using that particle size.

The ore is comminuted, or ground, before roasting to a range of particle sizes, i.e., from about 50% to about 90% passing through about 200 mesh (−200M) sieve (U.S. or Tyler size), and of a set moisture content, i.e., from about 0% to about 5% (and preferably less than about 1% if clays having water of crystallization are present).

Next, the ground ore is roasted in an oxygen-enriched gaseous atmosphere wherein the carbon and sulfur content is substantially completely oxidized from an initial roaster feed to a final calcine content as follows:

| | ROASTER FEED | | FINAL CALCINE CONTENT | |
|---|---|---|---|---|
| COMPONENT | From About | To About | From About | To About |
| Arsenic | 0.1% | 1.0% | 0.1% | 1.0% |
| Carbon (total) | 0.5% | 2.5% | 0.02% | 0.1% |
| Sulfur (total) | 0.5% | 5.0% | 0.05% | 0.1% |

Ninety-eight percent or greater of the sulfur content and 90 percent or greater of the carbon content are respectively oxidized during roasting. For extraction of gold from these refractory ores, an important consideration is the completeness of the oxidation of the carbon and sulfur values. Final carbon values at 0.05% to 0.1% provide good results. The same applies to sulfide sulfur levels, with final sulfide sulfur values at 0.05% to 0.1% providing good results. However, the final carbon level is important since it can negatively affect gold recovery by "preg robbing" during the leaching operation.

While there is no seemingly apparent reduction in arsenic content, this is highly desirable since it is indicative of the lack of volatilization and/or immobilization of the arsenic content and ability of iron and other additives to sequester and/or react with the arsenic in the ore and keep it in a form without causing any interference with gold recovery and subsequent long term arsenic solubilization. In other words, the arsenic content is beneficially retained in the solid phase ore/calcine rather than being volatilized (with a consequent need for supplemental precautionary measures.)

Typically, greater than about 95% of the arsenic is fixed in the calcine by the presence of a e.g. proper amount of iron. If desired, additional iron may be added to facilitate this conversion to an insoluble form. By having greater than a ratio from about 3.5:1 and e.g. 4:1 of iron to arsenic (molar ratio), ferricarsenate compounds formed during roasting render the arsenic in a fixed form in the calcine. Further, the ferricarsenate compound is insoluble in the subsequent leaching and from the tailings in dump storage after the gold values are extracted. Consequently, not only are the arsenic values not volatilized by the process of the present invention by retaining them in the calcine in a nonvolatile form, but also these arsenic values can be retained in a form which is insoluble to the leaching and insoluble over a long period while in a dump. A triple benefit results—reduced arsenic volatilization, long-term arsenic immobilization, and no impairment of gold recovery.

For the present invention the reaction temperature of the oxygen-enriched gaseous atmosphere during roasting is controlled preferably such that it is from about 475° C. to about 600° C.

In another aspect of the invention and especially when volatilized arsenic compounds are formed at higher temperatures and thereafter converted to resoluble compounds, higher temperatures are used. However, for the arsenic sequestration without arsenic volatilization and/or solubilization, sintering is to be avoided, i.e. molten phase formation should also be prevented since molten phase silicates formed/or even partial sintering, make the precious metal content of the ore less amenable to recovery. Further, the reaction temperatures in the reactor apparatus must be sufficiently high to optimize the oxidation reaction, particularly the oxidation of carbon- and sulfur-containing components and formation of e.g. ferricarsenate compounds. It has been found that a reaction temperature in the reaction apparatus for the oxygen-enriched gaseous atmosphere of from about 475° C. to about 600° C. is desirable, while a preferred temperature range is from about 500° C. to about 575° C.

While the objective of the oxidation of the carbon and sulfur content is the formation of oxides wherein carbon and sulfur are as completely oxidized as possible, the situation with respect to arsenic has more subtle ramifications since certain of its intermediate oxides, such as arsenic trioxide ($As_2O_3$) (boiling point 465° C.), volatilize at elevated temperatures as do certain of its sulfides, such as $As_2S_2$ (boiling point 565° C.), and $As_2S_5$ (sublimates at 500° C.). The focus, therefore, is on the formation of insoluble compounds with the substances recited above, such as ferricarsenate compounds, e.g. scorodite, to avoid the volatization problem and to keep arsenic values out of the process off-gas and keep these in a highly insoluble state. This control is one of the desirable results that the present invention achieves by a combination of steps including the reaction conditions, oxygen content, roasting residence time, iron content, step wise oxygen injection, etc. However, the present invention also addresses, as will be further discussed herein and shown by examples, the volatilized arsenic treatment in the off-gas by the proper formation of insoluble arsenic compounds.

The gaseous atmosphere in which, e.g. the gold ore is roasted is an oxygen-enriched gaseous atmosphere, such as oxygen-enriched air, having a total initial oxygen content, after enrichment, of less than about 65 percent (by volume), and desirably from about 25 percent (by volume) to about 60 percent (by volume); industrially a range of oxygen of 35% to 55% by volume is indicated for the process.

The ground ore is roasted as fluidized solids in the oxygen-enriched gaseous environment. In effect, the fluidized ore in the gaseous roasting atmosphere forms a two phase suspension in which ore is a discontinuous phase composed of discrete solid particles and the gaseous atmosphere is the continuous phase. In most instances, the ore concentrates will have sufficient oxidizable content that there will be an autothermal oxidation reaction during roasting. In those instances where there is not sufficient oxidizable content, such as for ore which does not support an autothermal reaction, additional oxidizable content is provided by adding a comburant so that there will be a thermal reaction during roasting. Typically a low ignition point fuel is added, e.g. coal or butane/propane. Hence, desirably the ignition point should be that of propane or below.

Fluidizing the ore facilitates the transfer of reactants and heat produced by the oxidation reaction, i.e., from the ore to the gaseous atmosphere and vice versa. It also increases both reaction velocity and reaction uniformity. Further, as a result of these factors and the law of mass reaction, reaction of e.g. the iron and arsenic values to ferricarsenate compounds and, therefore, arsenic volatilization can be controlled. The reaction pathway for iron and arsenic values appears to be the oxidation of iron and arsenic values to form ferricarsenates. Because of the great complexity of reactions in any ore during roasting such pathway as arsenic to ferricarsenate is merely surmised but the important point is e.g. the scorodite formation. For the other substances disclosed herein, similar end results are obtained. However, the ferricarsenates are the desirable end products such as in the scorodite form.

While the oxidation reaction of the carbon- and sulfur-containing components is generally exothermic, it may be necessary to raise initially the temperature of the ore and the temperature of the gaseous reaction atmosphere in order to initiate the oxidation. This may be accomplished by initially adding a comburant, such as a carbonaceous comburant like coal, or butane but typically coal; or other low combustion, i.e. flash point fuel. Moreover, if the stoichiometry of the ore is such that supplemental heat input is needed, the below-described fluid beds lend themselves well to such supplementation without any disadvantages.

As another embodiment, an ebullating bed may be used with the overflow from the ebullating bed being constantly circulated. The reaction velocity may be lower in an ebullating fluid bed. Efficiency and control over the oxidation and reaction conditions are improved by circulating the ore as fluidized solids. An advantage of a circulating fluid bed or an ebullating fluid bed is the precise control of the bed temperature; and although an employed temperature is ore specific within the above ranges, the control is maintained within +15° C. in a broader aspect; with ±10° C. being more typical and ±5° C. being preferred. Such temperature range permits even greater control over oxidation of the arsenic-, carbon- and sulfur-containing components and over reaction of the iron- and arsenic-containing components with each other while minimizing arsenic volatilization.

According to a preferred feature the roasting is performed in a circulating fluidized bed. The fluidized bed system consists of a fluidized bed reactor, a recycling cyclone and a recycling line. That fluidized bed differs from a classical fluidized bed, in which a dense phase is separated by a distinct density step from the overlying gas space and exhibits states of distribution having no defined boundary layer. There is no density step between the dense phase and an overlying dust space but the solids concentration in the reactor decreases continuously from bottom to top. A gas-solid suspension is discharged from the top of the reactor. In a definition of the operating conditions by the Froude and Archimedes numbers the following ranges are obtained:

$$0.1 \le 3/4 \times Fr^2 \times \frac{\int g}{\int k - \int g} \le 10$$

and $0.01 \le Ar \le 100$ wherein $$Ar = \frac{d_k^3 \times g\left(\int k - \int g\right)}{\int g \times V^2}$$

$$Fr2 = \frac{u^2}{g \times d_k} \quad \text{and}$$

| | |
|---|---|
| $u$ | the relative gas velocity in m/sec |
| $Ar$ | the Archimedes number |
| $Fr$ | the Froude number |
| $\int g$ | the density of the gas in kg/m$^3$ |
| $\int k$ | the density of the solid particle in kg/m$^3$ |
| $d_k$ | the diameter of the spherical particle in m |
| $V$ | the kinematic viscosity in m$^2$/sec |
| $g$ | the constant of gravitation in m/sec$^2$ |

The suspension discharged from the fluidized bed reactor is fed to the recycling cyclone(s) of the circulating fluidized bed and substantially all solids are removed from the suspension in said cyclone(s). The solids which have been removed are returned to the fluidized bed reactor in such a manner that the solids circulated in the circulating fluidized bed systems amount to at least four times the weight of solids contained in the fluidized bed reactor.

Circulating fluidized bed technology is further discussed in e.g. G. Folland et al., "Lurgi's Circulating Fluid Bed Applied to Gold Roasting", *E & MJ*, 28–30 (October 1989) and Paul Broedermann, "Calcining of Fine-Grained Materials in the Circulating Fluid Bed", *Lurgi Express Information Bulletin—C* 1384/3.81, the disclosures of which are incorporated herein by reference.

The residence time of the ore in the oxygen-enriched gaseous atmosphere should be from about 8 to 10 minutes preferably from about 10 minutes to about 12 or more, but constrained by practical design considerations such as vessel size; pump size etc. It should be understood that residence time is a function of ore mineralogy. Control of residence time at temperature also controls silicate melting which is to be avoided since the porosity created by sulfidic sulfur oxidation is then vitiated. High porosity and low sintering is desirable for the subsequent leaching of gold.

Following roasting, the precious metal values are recovered from the thus-roasted ore, or calcine, by leaching, such as by cyanidation, carbon-in-leach cyanidation or carbon-in-pulp cyanidation. Such leaching techniques are known in the art and are described in general in U.S. Pat. Nos. 4,902,345 and 4,923,510, whose disclosures are incorporated herein by reference.

As a bench mark comparison of the roasting efficiency and completion of the present invention, conventional fluid bed roasting for equivalent length of time at the same conditions provides a measure by which the present invention may be evaluated. Another measure of efficiency and completion are the amount of cyanide used to extract an equivalent amount of gold, or residual amounts of gold in ore after standard extraction procedures. According to the above measures, evaluation of ore of the same mineralogy will give the outstanding advantages of the present invention.

The thus-roasted gold ore may be subjected to an oxygen or chlorine treatment after roasting and prior to leaching. This treatment may be in the form of bubbling gaseous oxygen or chlorine through a suspension or a slurry of the thus-roasted ore either in a bath at ambient pressure or in a closed vessel at ambient or elevated pressure prior to leaching the ore.

The precious metal recovery provided by the present invention from refractory ores which include arsenic-, carbon- and sulfur-containing components is much improved, reaching levels of 75–90% and in some cases higher, such as 92%. It must be understood that the mineralogy of the ore will influence the results. Conventionally pyritic sulfides, sulfides and carbon affect recovery and higher or lower arsenic content makes it more or less expensive to treat the ore to meet today's environmental demands.

DESCRIPTION OP THE ILLUSTRATIONS SHOWN IN THE DRAWING

In FIG. 1 a self-explanatory flow diagram has been provided. This generic flow diagram should be considered in combination with a schematic industrial embodiment shown in FIG. 7 for gold recovery from gold ores and also amplified further herein by the data shown in Table 7.

As one of the advantageous aspects of this invention, heat recovery (i.e. as a cost advantage) in this process may be readily practiced. For example heat may be recovered not only from the off-gases from the one stage roasting such as derived from a circulating fluid bed or an ebullating fluid bed, but also by cooling a calcine with air or air enriched with oxygen e.g. of up to 65% oxygen by volume. Such air cooling is taught in U.S. Pat. No. 4,919,715 to supposedly reduce the recovery of gold, apparently by as much as 2%, but we have found it not to be detrimental, if anything, such heat recuperation seems to have improved the yields.

Another aspect of the invention which has not been mentioned or apparent from the immediately above-mentioned patent is that subsequent liquid quenching allows reduction of cyanide consuming materials. These materials are rendered soluble by the low temperature oxygen roasting and low temperature oxygen post-finishing of the calcine during cooling. Such post-finishing provides excellent sulfation at acidic conditions, e.g. making of $Fe_2(SO_4)_3$ and like compounds of metals such as copper, nickel, antimony, zinc, lead etc. The removal of these compounds during liquid quench reduces cyanide consumption during leaching from 2 to 10 pounds more typically from 5 to 10 pounds of cyanide per ton of calcine to less than one pound e.g. typically 0.3 pound of cyanide per ton of calcine.

Figure 2:
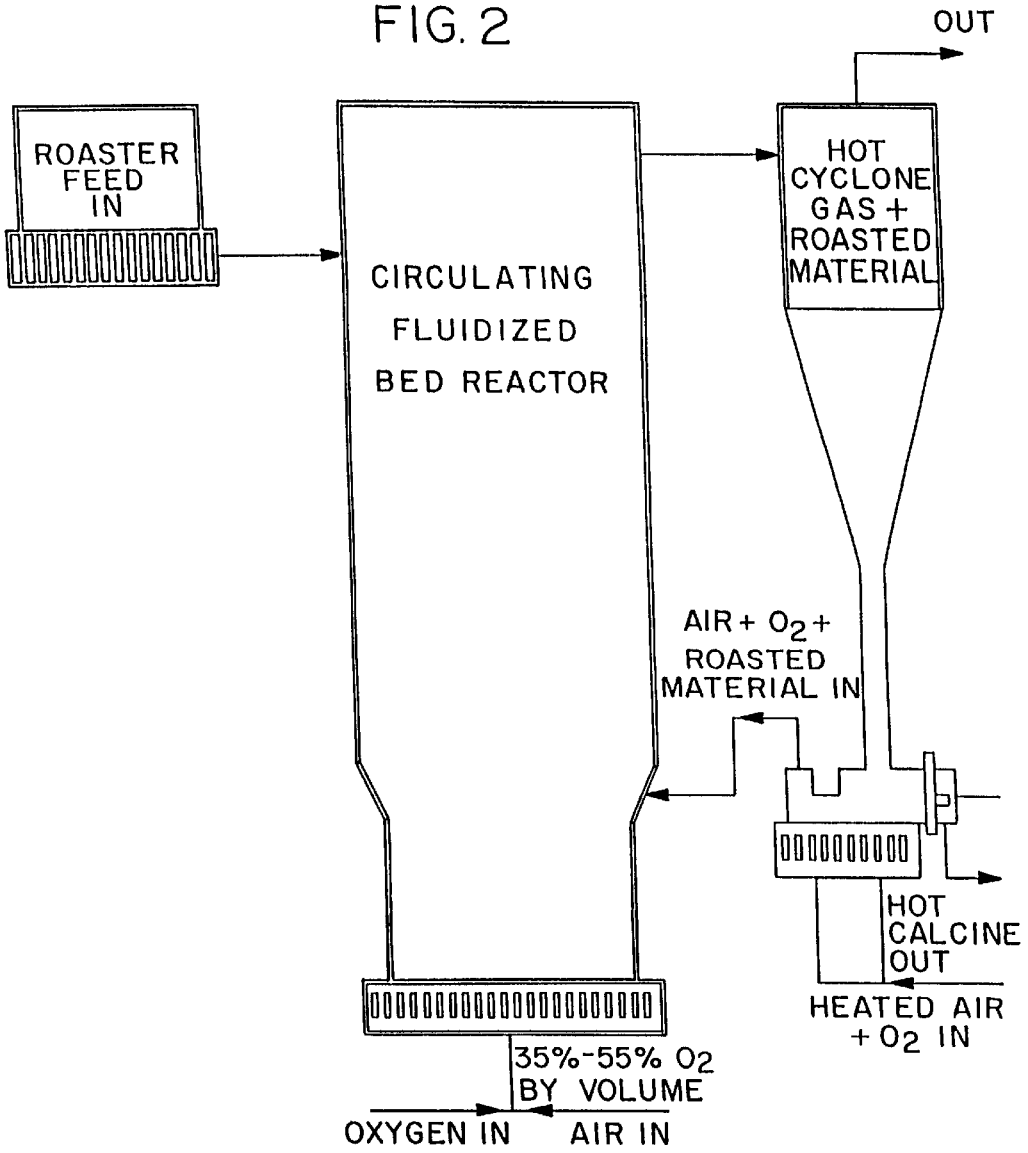
FIG. 2 is a side elevation in vertical section of the roasting apparatus in accordance with the present invention showing a circulating fluidized bed.

In FIG. 2 a schematic representation of appropriately labeled circulating fluidized bed (CFB) has been shown. The air input at the bottom of the bed with the recirculating material from the hot cyclone (or a plurality of cyclones in parallel, e.g. two) keep the bed in a high degree of turbulence assuring excellent i.e. almost instantaneous temperature uniformity and reaction conditions. Typically the complete residence time in such bed may be based on a number of passes of the bed contents through the bed, but it is best to express it as overall nominal residence time for the bed contents. It should be understood that a residence time is a summation time of the circulating particles in such bed. It is believed that the post-finishing of the calcine during cooling has the above-mentioned advantageous effect for any particle which may have escaped the necessary residence time in the circulating fluid bed, yet at no overall reduction of residence efficiency and gold recovery.

Figure 3:
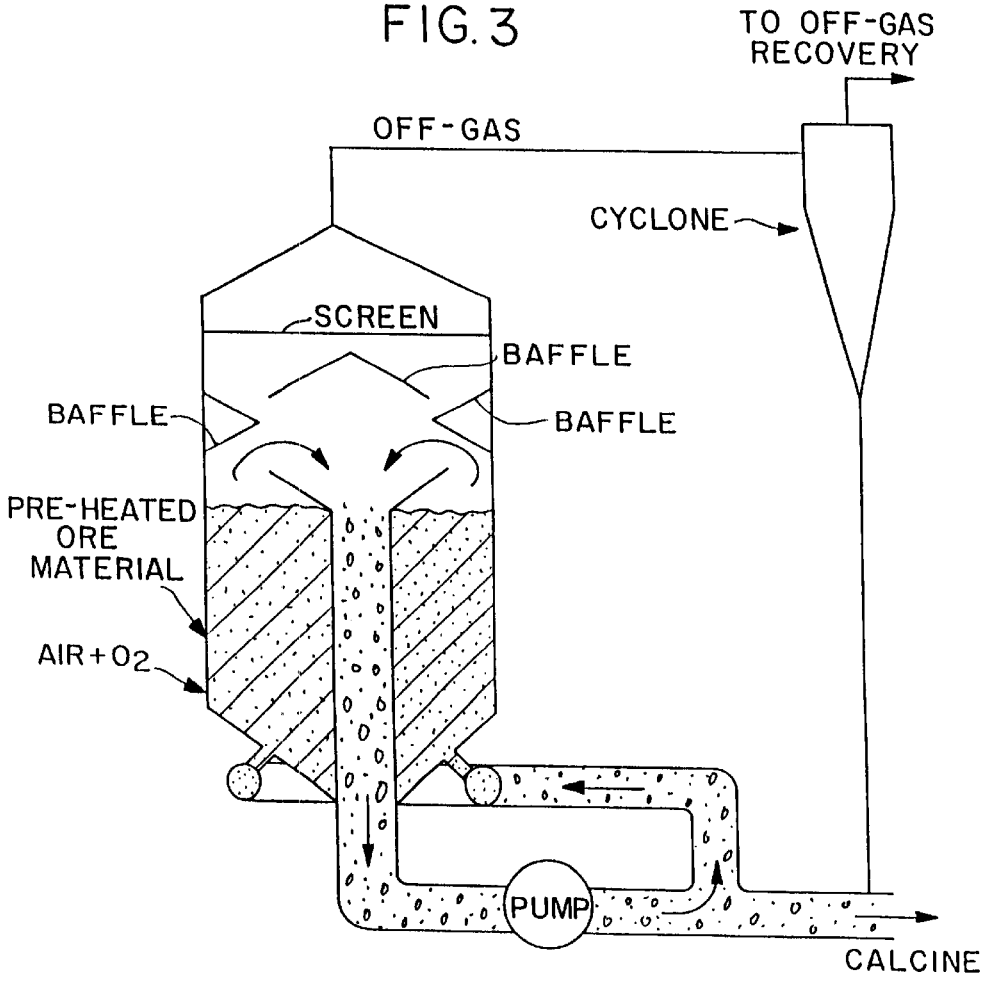
FIG. 3 is a side elevation in vertical section of the roasting apparatus in accordance with the present invention showing an ebullating fluidized bed.

FIG. 3 shows an ebullating fluid bed which is an embodiment of a fluid bed suitable as another approach in the disclosed process. The appropriately labeled illustration provides for another circulation approach when roasting an ore material.

Figure 4:
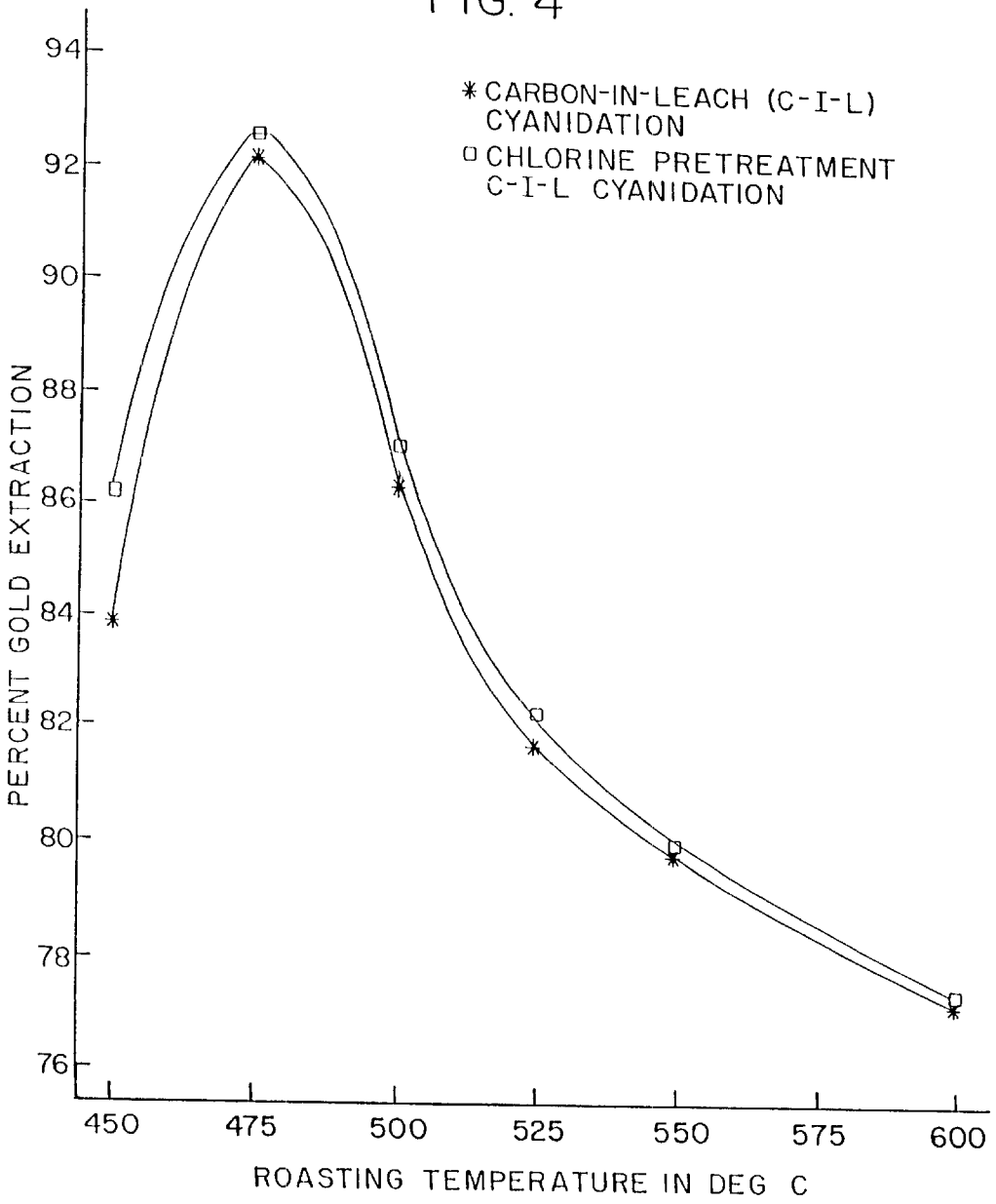
FIG. 4 is a graph of the percent of gold extraction versus the reaction temperature of the oxygen-enriched gaseous atmosphere during roasting based on both leaching with a carbon-in-leach/sodium cyanide leaching and a carbon-in-leach/sodium cyanide leaching with a sodium hypochlorite pretreatment of the roasted ore.
Figure 5:
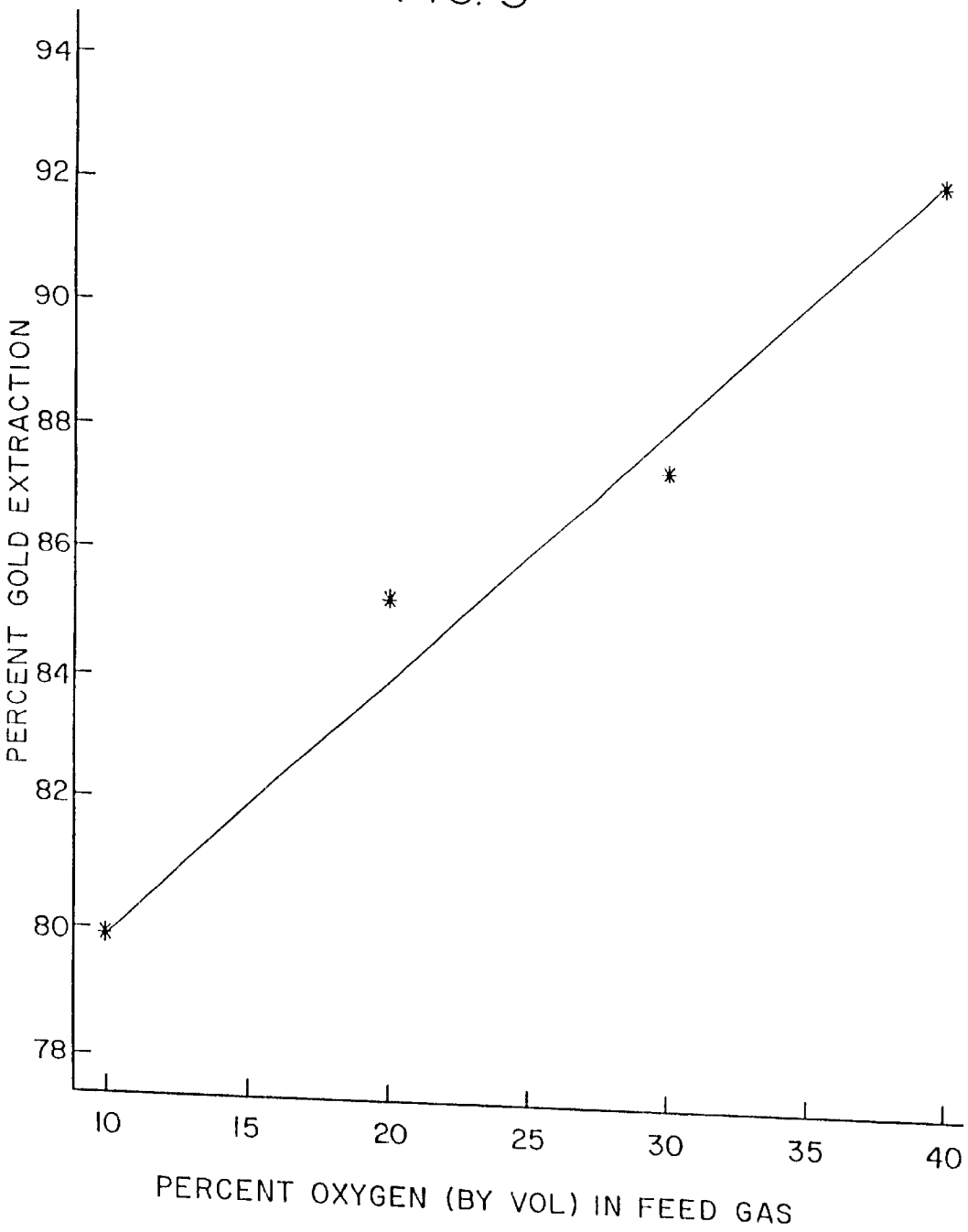
FIG. 5 is a graph of the percent gold extraction versus the percent oxygen by volume in the feed gas to the oxygen-enriched gaseous roasting atmosphere.
Figure 6:
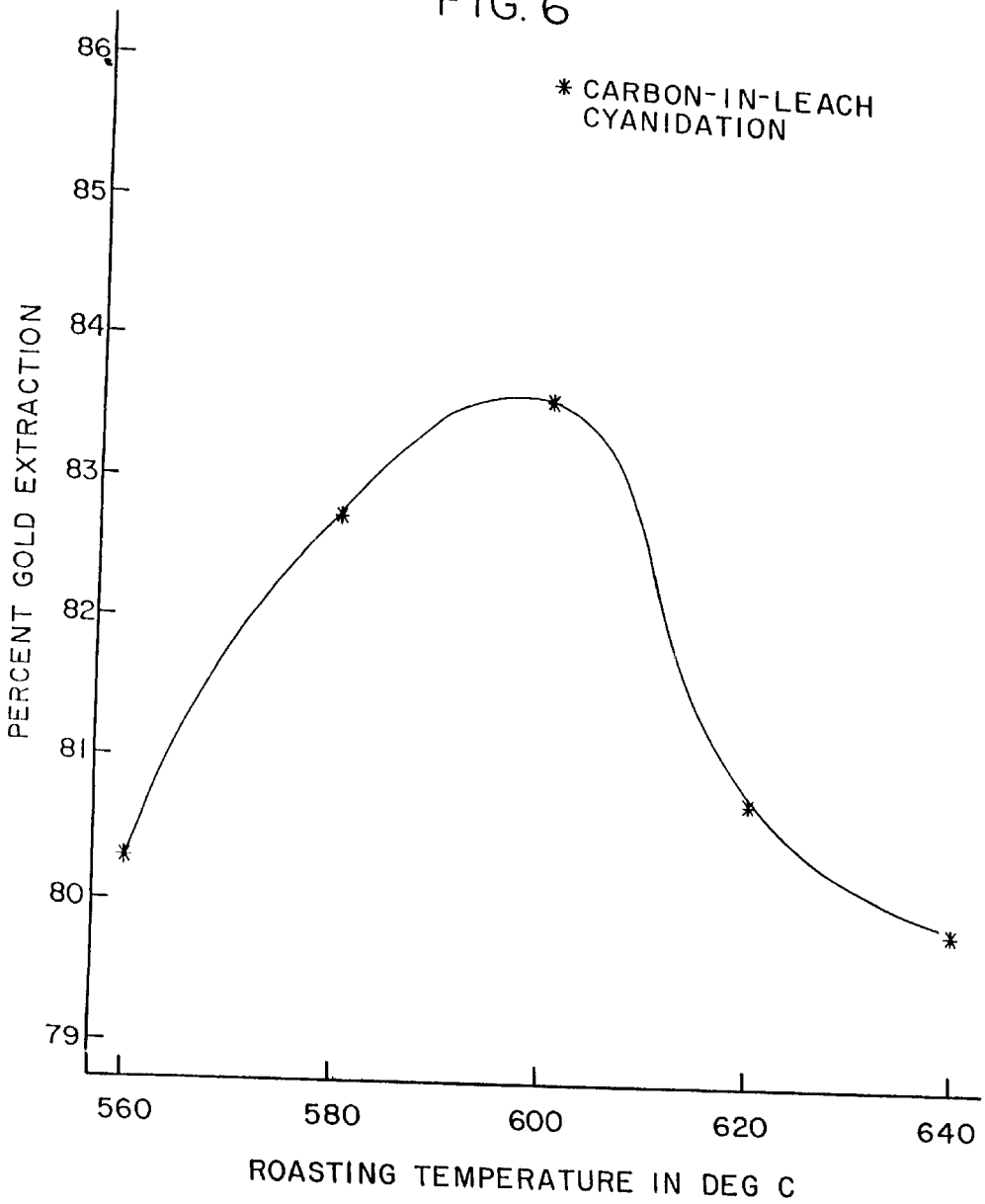
FIG. 6 is a graph of the percent of gold extraction versus the reaction temperature of the air atmosphere during roasting based on leaching with a carbon-in-leach/sodium cyanide leaching of the roasted ore.

FIGS. 4 to 6 will be further explained in conjunction with the Examples. FIGS. 4 and 6 illustrate the "knee-in-the-curve" found for the roasting conditions existing as a function of roasting temperature, oxygen content in roasting gas i.e. air, and as a function of gold extraction.

Figure 7:
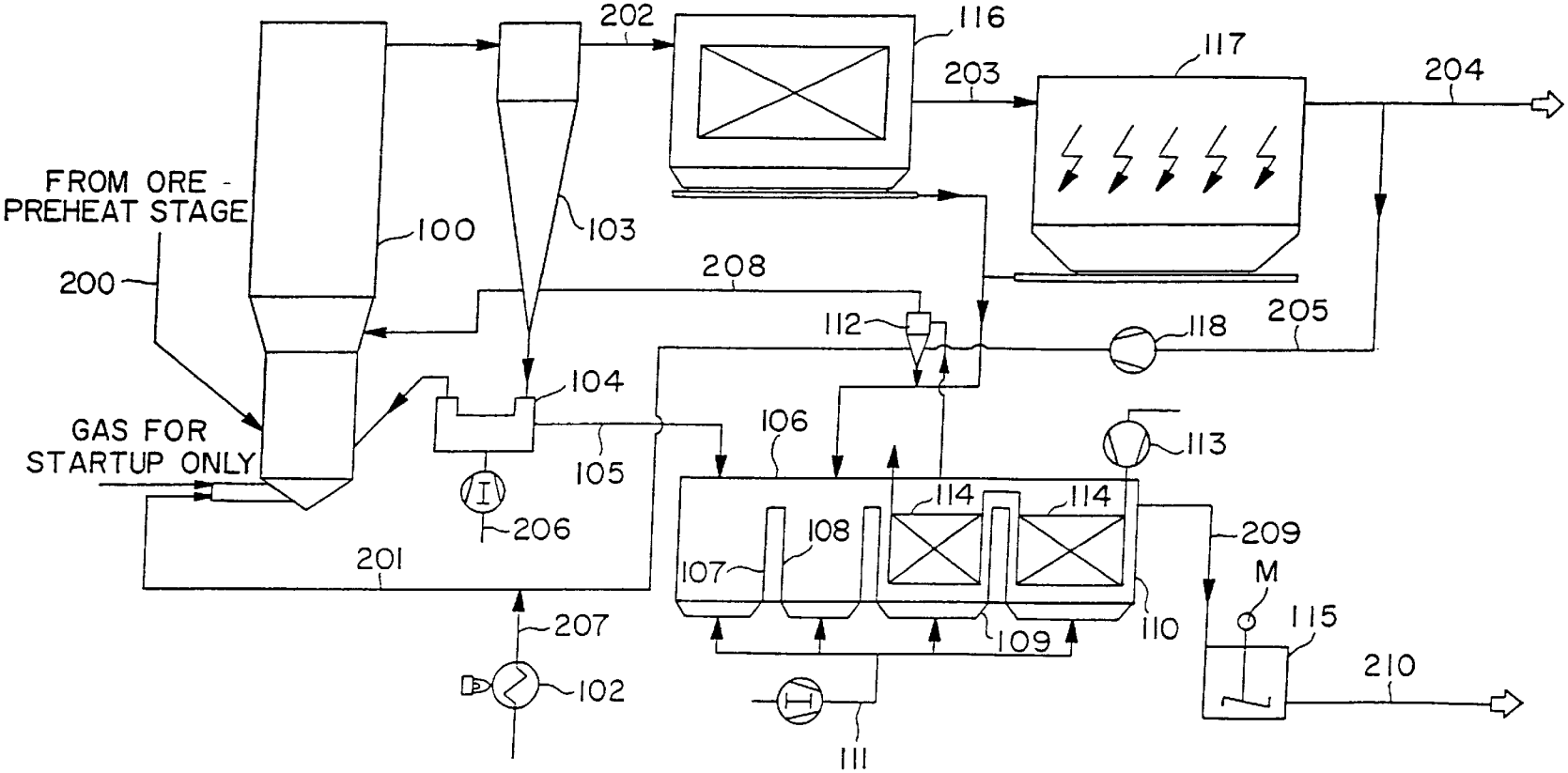
FIG. 7 is a schematic drawing of an industrial embodiment of the present invention.

In FIG. 7 an embodiment showing a schematic industrial application of the process is illustrated in greater detail and amplifies the flow chart of FIG. 1. Other FIGS., i.e. 8 to 11 will be discussed in conjunction with the Examples 8 and 9 herein.

A circulating fluid bed (CFB) reactor 100 is fed from an ore preheat stage identified with stream 200 corresponding to the same stream number in Table 7 further disclosed herein. A start-up gas stream such as butane/propane has been shown entering the CFB reactor 100 at the bottom thereof. Additionally, a combined stream of oxygen unexhausted off-gas and fresh oxygen via preheater 102 is introduced into the CFB reactor 100. The combined stream is identified as 201. Further, a preheated, oxygen supplemented air stream 208 is introduced in the CFB reactor 100 and is coming from the post-finishing calcine treatment which will be discussed below. A single cyclone 103 has been shown in FIG. 7, but more than one may be operated in parallel or in series to assure greater particulate removal from the off-gas. Cyclone 103 bottoms i.e. underflow collections are partially reintroduced into the CFB reactor 100 via seal pot 104. A slip stream 105 of calcined product is also taken from seal pot 104 and introduced into a four stage pre-heaters (recuperators) 107 to 110 which are in a heat recovery unit 106. Air augmented with oxygen is brought up to about 450° C. in heat recovery unit 106. The unit 106 consists of four pre-heaters in the form of fluidized beds 107, 108, 109 and 110, respectively. Because the conditions in each of the pre-heater beds are different, these pre-heaters 107, 108, 109 and 110 have been identified by separate numbers. Typically, the CFB reactor 100 is operated at 550° C. The resulting calcine (of retention time of 10 minutes in reactor 100) is introduced in the first pre-heater 107. The calcine is at a temperature of about 525° C. and has a residence time of about 15 minutes in preheater 107; in the second pre-heater 108, the calcine temperature is about 475° C. and residence time is about 10 minutes; in the third pre-heater 109 the calcine temperature is at about 420° C. and the residence time is about 8 minutes; in the fourth pre-heater 110 the calcine temperature is about 350° C. and the residence time is about eight minutes. Air and oxygen enter these preheaters in parallel, fluidized in each the calcine, and is mixed and cleaned in cyclone 112. After separation of particulates in cyclone 112, air and oxygen is introduced as stream 208 into the CFB reactor 100. A second pre-heater unit (not shown) of the same type may be operated in parallel to the first pre-heater unit 106. The seal pot 104 or a second seal pot (not shown) may feed the second pre-heater unit. In the data shown in Table 7, these are referred to two parallel identical pre-heater units such as 106, two parallel cyclones such as 112, and two parallel seal pots such as 104.

Heated air and oxygen from all four pre-heaters is used and is at about 450° C. as shown in Table 7. However, in addition ambient air is introduced via pump 113 into heating coils 114 immersed in the fluidized calcine in pre-heaters 109 and 110. This air is used to pre-heat in a CFB type vessel (not shown) the ore introduced as stream 200 in the CFB reactor 100. Hot air exits heating coils 114 at 200° C. As contemplated, but subject to change in the mineralogy of the ore, the balance of the energy requirement for roasting is made up by the addition of butane or pulverized coal to the CFB reactor 100. Calcine in stream 209 is quenched in water in tank 115 to a 15% solids content and further worked-up as previously described for removal of a cyanicide materials, neutralization and subsequent leaching.

Off-gases, i.e. cyclone 103 overflows are introduced into a waste heat boiler 116 where the off-gas temperature is reduced to about 375° C., dust from the waste heat boiler 116 is introduced into the pre-heater unit in an appropriate place, e.g. pre-heater 108 and combined with calcine. From waste heat boiler 116, the off gases are introduced into an electrostatic precipitator 117, e.g. a five field, hot electrostatic precipitator, to remove substantially all residual dust in the off-gas. A number of precipitators 117 may be used. The exit temperature of the off-gas from the electrostatic precipitator 117 is at about 350° C. and the off-gas comprises about 36% by volume of oxygen. About half of the exit gases are recycled via pump 118 to the CFB reactor 100. This recycle is a significant benefit because the off-gas cleaning system becomes about half the size if the off-gas is recycled. Precipitates from the electrostatic precipitator are also introduced into the calcine pre-heat unit(s) 106. The $SO_2$ laden exit gases may be sent directly to an acid plant and further amounts of oxygen introduced (as needed, for conversion of $SO_2$ to an acid as it is well known in the art). However, the excess oxygen rich gas from such plant may be recycled to the roasting side of the process and introduced such as in the CFB reactor 100 or used for calcine post-finishing, e.g. in fluidized beds 107, 108, 109 and 110 to aid in sulfating i.e. solubilizing the otherwise cyanide consumers.

In accordance with the present invention, a series of experimental runs were conducted which established the significant process parameters which show the previously unachieved results of which the present invention is capable.

The following examples illustrate the process of the present invention in the context of the recovery of gold.

EXAMPLE 1

The ore used in these runs came from a random sampling of arsenic-, sulfidic-, organic carbon-containing, gold-bearing ores from the region around Carlin, Nev. This ore, for the series of runs showed an average gold content of about 0.16 ounces of gold per ton of ore and up to 0.20 oz. of gold per ton, an average content of 0.08 percent arsenic, 2.49 percent sulfide sulfur (2.81 percent total sulfur) and 0.79 percent organic carbon (0.84 percent total carbon.) The ore was classified as pyritic-carbonaceous-siliceous ore and had the following mineralogical and chemical analyses:

Mineralogical Analysis

A typical analysis of this ore shows:

| | |
|---|---|
| Quartz | 68 Percent |
| Kaolinite | 10 Percent |
| Sericite or Illites | 8 Percent |
| Pyrite | 5 Percent |
| Jarosite | 4 Percent |
| Alunite | 3 Percent |
| $Fe_xO_y$ | 1 Percent |
| Barite | 1 Percent |
| Carbonates | 0 Percent |

Chemical Analysis:

A chemical analysis of the ore shows an average composition as follows:

| | |
|---|---|
| Arsenic | 824 parts per million |
| Carbon (Total) | 0.84 Percent |
| Sulfur (Total) | 2.81 Percent |
| Gold | 0.164 ounces per ton |
| Iron | 4.0 Percent |
| Zinc | 400 parts per million |
| Strontium | 0.02 Percent |

The ore was ground in a small ball mill to 100 percent −65 mesh (except as otherwise noted), i.e., 100 percent passed through a 65 mesh sieve, and it had a bulk density of about 57 pounds per cubic foot and a moisture content of about 1 percent.

The ground ore was placed in a simple rotating tube reactor and roasted in a batch operation to evaluate various reaction conditions using a residence time of two hours for the sake of consistency.

The roasted ore, or calcine, was treated by a carbon in leach cyanidation leach using a dosage of 6 pounds of sodium cyanide per ton of roasted ore and 30 grams per liter of activated carbon (available from North American Carbon.)

The leaching was conducted in a continuously rolling bottle under the following conditions:

1. 200 grams of calcine per leach test
2. 40% solids and
3. 24 hours leaching time.

A first series of runs was made roasting the ore with 40% oxygen (by volume) initially in the feed gas, or gaseous atmosphere, at the following temperatures and with the following results:

| Roasting Temperature (Degree C.) | Gold Extract (Percent) |
|---|---|
| 450 | 84 |
| 475 | 92 |
| 500 | 86.5 |
| 525 | 82 |
| 550 | 80 |
| 600 | 76.8 |

(The symbol * in the graph in FIG. 4 also shows these results.) When the roasted ore is treated with sodium hypochlorite at a rate of 25 pounds per ton of ore and using the same leaching technique, the results were as follows:

| Roasting Temperature (Degree C.) | Gold Extract (Percent) | Arsenic in Tailings ppm | Arsenic in Tailings % |
|---|---|---|---|
| 450 | 86 | 939 | 0.094 |
| 475 | 92.5 | 913 | 0.091 |
| 500 | 87.3 | 934 | 0.093 |
| 525 | 82.5 | 918 | 0.092 |
| 550 | 80.3 | 950 | 0.095 |
| 600 | 78 | 898 | 0.090 |

(The symbol □ on the graph in FIG. 4 also shows these results.)

a second run was undertaken in which the roasting temperature was held at 475 degrees Centigrade and the retention time at 2 hours, but the percent oxygen (by volume) in the feed gas, i.e., the total initial oxygen content of the gaseous atmosphere, was varied as follows and the following percentages of gold extraction were observed:

| Total Oxygen (by Volume) in Feed Gas (air + added oxygen) (Percent) | Gold Extraction (Percent) |
|---|---|
| 10 | 80 |
| 20 | 85.5 |
| 30 | 87.5 |
| 40 | 92 |

(These results are also shown in the graph of FIG. 5.)

Further, the following additional results were observed in the roasted ore and are set forth in Table 1.

TABLE 1

CALCINE ASSAYS AND LEACH RESULTS

| TOTAL INITIAL OXYGEN % | ARSENIC (PERCENT) % | SULFUR (SULFIDE) % | CARBON (ORGANIC)[1] % | GOLD[2] oz/ton | LEACH RESIDUE[3] oz/ton | CALCULATED HEAD[4] oz/ton | GOLD EXTRN. % | −200 MESH[5] % |
|---|---|---|---|---|---|---|---|---|
| 10 | 0.082 | 0.31 | 0.17 | 0.169 | 0.033 | 0.164 | 79.9 | 84.7 |
| 20 | 0.085 | 0.20 | 0.08 | 0.164 | 0.025 | 0.170 | 85.3 | 80.5 |
| 30 | 0.080 | 0.30 | 0.05 | 0.165 | 0.021 | 0.166 | 87.5 | 83.1 |
| 40[6] | 0.091 | 0.48 | 0.05 | 0.162 | 0.013 | 0.161 | 92.2 | 81.6 |

[1]Organic carbon is defined as acid insoluble carbon to distinguish from carbonates which are acid soluble.

[2]By fire assay determination.

[3]By fire assay determination.

[4]Calculated head is a comparison to the fire assay by using leach residue weight and loaded carbon weight and fire assay. It is used to make a material balance determination to ensure that there has been good gold accountability in the test.

[5]Through a 200 mesh sieve.

[6]This was conducted on material which passed through a 20 mesh sieve standard test procedure.

EXAMPLE 2

A series of air roasting tests was run in a six-inch rotating tube furnace with off gas oxygen content. (This resulted in approximately 4% to 6% oxygen by volume in the off-gas.) These tests used specimens of the same composition as the sample used in Example 1. The ore for this series of test runs showed an average gold context of about 0.164 ounces of gold per ton, 2.49 percent sulfide sulfur and 0.79 percent organic carbon. The ore was classified as sulfidic-carbonaceous ore. Sample preparation and test procedures used were the same as in Example 1. Table 2 and FIG. 5 present the comparative results. These tests demonstrate that low gold recoveries are achieved when roasting is conducted with air as the oxidizing atmosphere. These tests also demonstrate that the process of the present invention using oxygen-enriched air (such. as 40% oxygen by volume) allows better process control—at lower temperatures—for maximum gold recoveries.

TABLE 2

CALCINE ASSAY AND LEACH RESULTS - ROASTING IN AIR

| | ROAST CONDITIONS | | CALCINE HEAD ASSAYS | | | | | LEACH TEST RESULTS | | | |
|---|---|---|---|---|---|---|---|---|---|---|---|
| | | | | | | | | Au in LEACH | CALC. | AU | −200 |
| TEST NO. | TEMP ° C. | WT. LOSS % | S[1] % | C[2] % | As ppm | Hg ppm | Au oz/ton | TAIL oz/ton | HEAD[3] oz/ton | EXTRN % | MESH[4] % |
| 2-1 | 560 | 4.7 | .07 | .05 | 948 | .26 | .166 | .033 | .168 | 80.3 | 66.3 |
| 2-2 | 580 | 4.8 | .10 | .09 | 894 | .18 | .170 | .029 | .167 | 82.8 | 68.7 |
| 2-3 | 600 | 5.3 | .05 | .04 | 926 | .19 | .165 | .027 | .166 | 83.7 | 76.1 |
| 2-4 | 620 | 5.2 | .06 | .08 | 945 | .11 | .166 | .032 | .168 | 80.9 | 68.9 |
| 2-5 | 640 | 5.1 | .09 | .02 | 981 | .09 | .167 | .034 | .171 | 80.1 | 68.6 |

[1]Sulfide Sulfur.

[2]Organic carbon as residue after hydrochloric acid digestion.

[3]Calculated head is a comparison to the fire assay by using leach residue weight and loaded carbon weight and fire assay. It is used to make a material balance determination to ensure that there has been good gold accountability in the test.

[4]Percent through a 200 mesh sieve.

EXAMPLE 3

The ore used in these runs came from a random sampling of arsenic-, sulfidic-containing, gold bearing ores from the region around Carlin, Nevada. The ore for this series of runs showed an average gold content of about 0.14 ounces of gold per ton of ore, an average content of 0.15 percent arsenic, 2.15 percent sulfide sulfur (2.50 percent total sulfur) and 0.35 percent organic carbon (0.39 percent total carbon.) The ore was classified as pyritic-siliceous ore and had the following mineralogical analysis:

Mineralogical Analysis:

A typical analysis of this are shows:

| | |
|---|---|
| Quartz | 80 Percent |
| Sericite | 6 Percent |
| Pyrites | 4 Percent |
| Jarosite | 4 Percent |
| Kaolinite | 3 Percent |
| Alunite | 2 Percent |
| Barite | 1 Percent |
| $Fe_xO_y$ | 0 Percent |

Chemical Analysis:

An elemental analysis of the ore shows an average composition as follows:

| | |
|---|---|
| Arsenic | 0.15 Percent |
| Carbon (Organic) | 0.35 Percent |
| Sulfur (Sulfide) | 2.15 Percent |
| Gold | 0.14 Percent |
| Iron | 2.0 Percent |
| Zinc | 0.06 Percent |
| Strontium | 0.05 Percent |

The ore was ground in a small ball mill to 100 percent −100 mesh, i.e., 100 percent passed through a 100 mesh sieve (except as otherwise noted) and it had a bulk density of approximately 62 pounds per cubic foot and a moisture content of approximately 1 percent.

The ground ore was placed in a simple rotating tube reactor and roasted in a batch operation to evaluate various reaction conditions using a residence time of two hours for the sake of consistency. The ore feed to roast was 800 grams at −100 mesh.

The roasted ore, or calcine, was treated by a carbon-in-leach cyanidation leach using 5 pounds of sodium cyanide per ton of roasted ore and 30 grams per liter of activated carbon (available from North American Carbon.)

The leaching was conducted in a continuously rotating bottle under the following conditions:

1. 200 grams of calcine per leach test
2. 40% solids and
3. 24 hours leaching time.

The series of runs was made roasting the ore with 40% total oxygen (by volume) initially in the feed gas, or gaseous atmosphere, at the following temperatures and with the following results:

| Roasting Temperature (Degree C.) | Gold Extract (Percent) |
|---|---|
| 450 | 72.2 |
| 475 | 84.9 |
| 500 | 82.5 |
| 525 | 76.8 |
| 550 | 77.7 |
| 600 | 75.5 |

Table 3 also shows these and additional results.

TABLE 3

CALCINE ASSAY AND LEACH RESULTS - ROASTING IN 40% OXYGEN

| ROAST CONDITIONS | | | | CALCINE HEAD ASSAYS | | | | | LEACH TEST RESULTS | | | |
|---|---|---|---|---|---|---|---|---|---|---|---|---|
| TEST NO. | TEMP ° C. | FEED GAS[1] | WT. LOSS % | S[2] % | C[3] % | As ppm. | Hg ppm. | Au oz/ton | LEACH TAIL oz/ton | CALC.[4] HEAD oz/ton | GOLD EXTRN % | −200 MESH[5] % |
| 3-1 | 450 | 40 | 1.2 | .88 | .09 | 1416 | .82 | .145 | .042 | .150 | 72.2 | 68.2 |
| 3-2 | 475 | 40 | 2.0 | .29 | .29 | 1394 | .22 | .148 | .023 | .153 | 84.9 | 67.8 |
| 3-3 | 500 | 40 | 2.6 | .18 | .18 | 1528 | .32 | .146 | .027 | .154 | 82.5 | 67.5 |
| 3-4 | 525 | 40 | 2.8 | .10 | .10 | 1546 | .14 | .148 | .036 | .155 | 76.8 | 67.8 |
| 3-5 | 550 | 40 | 3.0 | .04 | .01 | 1327 | .29 | .147 | .034 | .152 | 77.7 | 72.5 |
| 3-6 | 600 | 40 | 3.0 | .02 | .01 | 1236 | .30 | .149 | .038 | .155 | 75.5 | 71.4 |

[1]Total initial oxygen content, percent oxygen by volume.
[2]As sulfide.
[3]Organic carbon as a residue after hydrochloric acid digestion.
[4]Calculated head is a comparison to the fire assay by using leach residue weight and loaded carbon weight and fire assays. It is used to make a material balance determination to ensure that there has been good gold accountability in the test.
[5]Percent through a 200 mesh sieve.

EXAMPLE 4

A series of roast tests was run in a six-inch rotating tube furnace with air as the input stream. (This resulted in approximately 4% to 6% oxygen by volume in the off-gas.) Specimens from the same sample as in Example 3 were used for these tests. Sample preparation and test procedures were the same as in Example 1. Table 4 presents the test results. These tests also demonstrate that when comparing to Table 3 results, the former show that gold recovery is maximized when oxygen-enriched air, e.g., 40% total oxygen in the feed gas, is used as the oxidizing medium.

Chemical Analysis:

| Chemical Analysis | | |
|---|---|---|
| Gold | 0.66 | Ounces per ton |
| Carbon (total) | 3.5 | Percent |
| Carbon (organic) | 0.0 | Percent |
| Sulfur (total) | 2.6 | Percent |
| Sulfur (sulfide) | 2.2 | Percent |
| Iron | 2.8 | Percent |
| Arsenic | 0.43 | Percent |
| Mercury | 56 | Parts per million |

TABLE 4

CALCINE ASSAY AND LEACH RESULTS - AIR ROASTING

| ROAST CONDITIONS | | | | | CALCINE HEAD ASSAYS | | | | | LEACH TEST RESULTS | | | |
|---|---|---|---|---|---|---|---|---|---|---|---|---|---|
| TEST NO. | TEMP ° C. | MESH SIZE[1] | TIME Hrs | WT. LOSS % | S[2] % | C[3] % | As ppm | Hg ppm | Au oz/ton | LEACH TAIL ozAu/ton | CALC HEAD oz/ton | GOLD EXTR % | −200 MESH % |
| 4-1 | 550 | −14 | 1.5 | 2.5 | .31 | .08 | 1125 | .54 | .146 | .043 | .148 | 70.8 | 81.7 |
| 4-2 | 550 | −14 | 2.5 | 2.7 | .22 | .06 | 1040 | .42 | .149 | .044 | .149 | 70.2 | 80.8 |
| 4-3 | 650 | −14 | 1.5 | 2.9 | .17 | .05 | 560 | .26 | .144 | .036 | .146 | 75.1 | 84.7 |
| 4-4 | 650 | −100 | 1.5 | 2.9 | .01 | .02 | 520 | .17 | .150 | .035 | .146 | 75.9 | 67.7 |
| 4-5 | 650 | −14 | 2.5 | 3.1 | .15 | .04 | 540 | .30 | .149 | .038 | .152 | 74.9 | 84.5 |
| 4-6 | 650 | −100 | 2.5 | 3.7 | .01 | .03 | 520 | .19 | .149 | .039 | .152 | 74.2 | 72.4 |
| 4-7 | 600 | −14 | 2 | 3.9 | .20 | .03 | 848 | .29 | .146 | .036 | .150 | 75.8 | 83.8 |
| 4-8 | 600 | −28 | 2 | 2.9 | .08 | .08 | 500 | .30 | .141 | .034 | .148 | 77.0 | 89.0 |

[1]Percent passed through a sieve of the specified mesh.
[2]Sulfide sulfur.
[3]Organic carbon as a residue after hydrochloric acid digestion.

EXAMPLE 5

A series of tests was conducted in a six-inch rotating tube furnace on a sample with high carbonate content to demonstrate that the high gold recoveries are achieved with the process of the present invention. For comparison, three air roasts are presented along with the example that illustrates the present invention. Sample preparation and test procedures used were the same as in Example 1. Table 5 shows the test results. The analysis of the sample was:

Mineralogical Analyses:

| X-RAY Diffraction Analysis | | | X-RAY Fluorescence Analysis | | |
|---|---|---|---|---|---|
| Quartz | 29 | Percent | Zirconium | .03 | Percent |
| Sericite | 4 | Percent | Titanium | .04 | Percent |
| Kaolinite | 18 | Percent | Barium | .85 | Percent |

-continued

| X-RAY Diffraction Analysis | | X-RAY Fluorescence Analysis | |
|---|---|---|---|
| Alunite | 26 Percent | Nickel | .02 Percent |
| Jarosite | 9 Percent | Vanadium | .02 Percent |
| Pyrite | 3 Percent | Strontium | .04 Percent |
| Barite | 1 Percent | Zinc | .03 Percent |
| $Fe_xO_y$ | 2 Percent | | |
| Diopside | 7 Percent | | |

TABLE 5

TEST RESULTS FOR THE HIGH CARBONATE SAMPLE

| ROAST TEMP. DEG. C. | LEACH RESIDUE Au oz/ton | GOLD EXTRACTION % | −200 MESH[1] % | COMMENTS |
|---|---|---|---|---|
| 525 | .077 | 88 | 80 | Oxygen-Enriched Roast[2] |
| 550 | .105 | 84 | 80 | Air Roast[3] |
| 600 | .132 | 80 | 89 | Air Roast[3] |
| 650 | .138 | 79 | 86 | Air Roast[3] |

[1]Passed through a 200 mesh sieve
[2]Feed gas was air enriched to 40% total oxygen content (by volume.)
[3]Feed gas was air and the off-gas composition was maintained at 6% to 8% oxygen by volume.

EXAMPLE 6

A series of pilot plant tests was conducted in a six-inch fluidized bed reactor and an eight-inch fluidized bed reactor on a sulfidic carbonaceous sample with the following chemical and mineralogical composition:

Chemical Analysis:

| Chemical Analysis | |
|---|---|
| Gold | 0.13 Ounces per ton |
| Carbon (total) | .82 Percent |
| Carbon (organic) | .78 Percent |
| Sulfur (total) | 3.1 Percent |
| Sulfur (sulfide) | 2.6 Percent |
| Iron | 2.7 Percent |
| Arsenic | 0.09 Percent |
| Mercury | 4.7 Parts per million |

Mineralogical Analyses:

| X-RAY Diffraction Analysis | | X-RAY Fluorescence Analysis | |
|---|---|---|---|
| Quartz | 71 Percent | Zirconium | .01 Percent |
| Sericite | 5 Percent | Titanium | .12 Percent |
| Kaolinite | 11 Percent | Barium | .85 Percent |
| Alunite | 3 Percent | Nickel | .03 Percent |
| Jarosite | 5 Percent | Vanadium | .05 Percent |
| Pyrite | 4 Percent | Strontium | .05 Percent |
| Barite | 1 Percent | Zinc | .10 Percent |
| $Fe_xO_y$ | 0 Percent | Lead | .01 Percent |

The sample preparation procedure for this series of tests included crushing, wet grinding in a ball mill to 100% passing through a 65 mesh sieve, solid/liquid separation, and drying prior to roasting. The dry sample was fed to the roaster via a screw feeder with the combustion gas consisting of either air alone or air enriched to 40% total initial oxygen content by volume. Solids exiting the roaster were carbon-in-leach cyanide leached at the same conditions as in Example 1.

Table 6 presents the test results. From the results it is seen that maximum gold recoveries are achieved by using the process of the present invention. By way of comparison, several air roasts conducted in a circulating fluidized bed roaster and a stationary fluid bed roaster are presented along with three examples that illustrate the present invention.

Residual sulfide sulfur content and organic carbon content of the solids exiting from the pilot plant roaster were less than 0.05 percent by weight in all the tests from this series.

TABLE 6

Test Results From Pilot Plant in Fluidized Bed Roasters

| ROAST TEMP. DEG. C. | OXYGEN IN OFF-GAS % | LEACH RESIDUE oz/ton | CALC HEAD oz/ton | GOLD EXTRN % | COMMENTS |
|---|---|---|---|---|---|
| 525 | 37 | .019 | .131 | 85 | Oxygen Roast[1] |
| 550 | 38 | .020 | .137 | 85 | Oxygen Roast[1] |
| 550 | 38 | .016 | .131 | 88 | Oxygen Roast[2] |
| 625 | 6 | .046 | .131 | 65 | Air Roast[3] |
| 675 | 6 | .044 | .137 | 68 | Air Roast[3] |
| 725 | 6 | .044 | .133 | 67 | Air Roast[4] |
| 600 | 6 | .034 | .134 | 75 | Air Roast[5] |
| 600 | 6 | .028 | .133 | 79 | Air Roast[5] |

[1]Test conducted in a six-inch circulating fluidized bed roaster with a combustion gas of air enriched to 40% oxygen by volume.
[2]Same as in footnote 1 but the test was conducted in an eight-inch circulating fluid bed roaster.
[3]Test conducted in a six-inch circulating fluid bed roaster with air as the combustion gas and the composition of the off-gas was maintained at 6% oxygen by volume.
[4]Same as in footnote 3 but the test was conducted in an eight-inch circulating fluid bed roaster.
[5]Test conducted in a six-inch stationary fluid bed roaster with air as the combustion gas and the composition of the off-gas was maintained at 6% oxygen by volume.

The foregoing examples demonstrate that the process of the present invention produces significantly desirable results from refractory ores with arsenic-, carbon- and sulfur-containing components while reducing the cost of oxygen-based roasting and minimizing arsenic volatilization.

It is noteworthy, particularly by comparing air roasting, such as those in Example 2, with oxygen-enriched air roasting, such as those in Example 1, that the present invention effectively lowers the temperature at which optimum gold recovery occurs. This is graphically demonstrated by comparing FIG. 6, which is for air roasting, with FIG. 4 which is for 40% oxygen-enriched air roasting. In FIG. 6 (air roast) the maximum gold recovery is at 600 degrees Celsius while in FIG. 4 (oxygen-enriched air roast) the maximum gold recovery is at 475 degrees Celsius. The importance of this is that the process of the present invention is more energy-economical. FIG. 5 shows that the percent gold extraction generally increases as the total oxygen content in the feed gas increases, with a practical, economical upper range based on other considerations such as operating costs, oxygen gas costs, equipment costs, etc.

EXAMPLE 7

In a schematic industrial illustration shown in FIG. 7 and described above, the following process data illustrate the application of the present invention.

The base case roaster feed analysis is as follows:

| | |
|---|---|
| Carbon Organic | 0.8% |
| Sulfide Sulfur | 2.5% |
| Weight Loss on Ignition - L.O.I. | 6.0% |
| As | 1200 ppm |
| Cl | 100 ppm |
| F | 1000 ppm |
| Pb | 25 ppm |
| Hg | 5 ppm |
| Sb | 80 ppm |
| Zn | 1000 ppm |
| $SiO_2$ | 80% |
| $Al_2O_3$ | 7% |

The following x-ray diffraction analysis was used to further characterize the above ore mixture:

| | |
|---|---|
| Sericite | 5% |
| Kaolinite | 11% |

-continued

| | |
|---|---|
| Alunite | 3% |
| Jarosite | 5% |

The ore feed had a specific gravity 2.52; and a bulk density (loose) of 1.0 m.t./$m^3$ and bulk density (packed) of 1.25 m.t./$m^3$. Roaster feed (D50) was: 50% passed at 19$\mu$ size and 80% passed at 70$\mu$ (estimate). The design roast temperature was 550° C. and the $O_2$ concentration in off-gas was 36 vol. % wet basis. Organic carbon burn-off was assumed to be 0.7% (for energy calculations).

As illustrated by the above x-ray diffraction analysis it shows the ores to contain a variety of clay compounds predominantly kaolinite but also alunite, jarosite and sericite. These compounds all have varying decomposition energies (all assumed to be endothermic). At a roasting temperature of 525–550° C. all of the clays would be decomposed and hence all of the waters of crystallization would end up in the vapor phase.

Volatilization in roaster was taken for each elements as follows: Mercury 100%; Arsenic 1%; Fluorine 15% and Chlorine 100%.

Based on the above data, an illustration of an industrial operation as described in conjunction with FIG. 7 is shown in Table 7; this table must be read in conjunction with the description of the process in FIG. 7.

TABLE 7

PROCESS DATA FOR A CIRCULATING FLUID BED ROASTING PLANT SHOWN IN FIG. 7

| Stream No. | | 200 | 201 | 202 | 203 | 204 | 205 | 206 | 207 | 208 | 209 | 210 |
|---|---|---|---|---|---|---|---|---|---|---|---|---|
| Medium | | Ore | Gas | Gas | Gas | Gas | Gas | Air | Air | Air | Calcine | Calcine Slurry |
| Solids, | mt/h | 160 | | 38.5 | 35 | | | | | | 154 | 154 |
| dry | st/h | 176 | | 42 | 38 | | | | | | 170 | 170 |
| Water | mt/h | 4.1* | | 7.8 | 7.8 | 4.1 | 3.7 | | | | | 873 |
| | st/h | 4.5* | | 8.6 | 8.6 | 4.5 | 4.1 | | | | | 963 |
| Gas, | $m^3n/h$ | | 36100 | 47500 | 47500 | 25000 | 22500 | 1000 | 13600 | 7000 | | |
| wet | scfm | | 21365 | 28100 | 28100 | 14790 | 13315 | 590 | 8050 | 4140 | | |
| $SO_2$ | vol % | | 5.7 | 9.15 | 9.15 | 9.15 | 9.15 | | | | | |
| $SO_3$ | vol % | | 0.3 | 0.45 | 0.45 | 0.45 | 0.45 | | | | | |
| $CO_2$ | vol % | | 6.7 | 10.8 | 10.8 | 10.8 | 10.8 | 21 | | | | |
| $O_2$ | vol % | | 56.3 | 36 | 36 | 36 | 36 | 79 | 90 | 48 | | |
| $N_2$ | vol % | | 18.2 | 23.2 | 23.2 | 23.2 | 23.2 | | 10 | 52 | | |
| $H_2O$ | vol % | | 12.8 | 20.4 | 20.4 | 20.4 | 20.4 | | | | | |
| Temp. | ° C. | 200 | 325 | 550 | 375 | 350 | 350 | 25 | 325 | 450 | 350 | ~40 |
| | ° F. | 392 | 617 | 1022 | 707 | 662 | 662 | 77 | 617 | 842 | 662 | ~104 |
| Pressure | mbar | +100 | +200 | −15 | −20 | −25 | −25 | +/−0 | +200 | +75 | +/−0 | |
| | inch | +40 | +80 | −6 | −8 | −10 | −10 | | +80 | +30 | | |

*Water of crystallization in ore components mt/h = metric tons per hour st/h = short tons per hour $m^3n/h$ = cubic meters normal per hour scfm = standard cubic feet per minute For the above illustration, a carbon content in the ore was provided for at 0.8% level, but should also be provided for a range from about 0.4% to about 1.15%. However, at still lower amounts of carbon in ore, more coal or fuel needs to be added, while at higher amounts of carbon in ore less or no coal is required (autothermal conditions). Hence, about 330 kg/hr of coal calculated as carbon is added for the above ore in Table 7. Besides the heat recovered in heat recovery unit 106, the waste heat boiler 116 produces at the specified conditions about 6 tons per hour of 55 bar steam.

In the above illustration, it is noted that a total "at temperature" time for the calcine (before quenching) is about 30 minutes. Such "at temperature" time is a combined time in the CFB reactor 100 and during post-finishing in heat recovery unit 106. This "at temperature" time may range from about 25 minutes to 50 minutes and does not adversely affect the gold recovery even for the longer period; therefore, this process has an advantage because it is also free from the heat sensitivity, i.e. "at temperature" time limits such as cautioned against in some of the prior art processes and disclosures thereof.

reactor 301 as a fluidizing gas. The reactor 301 was indirectly heated and a temperature between 550° and 570° C. was adjusted in the reactor. The reactor 301 was fed through line 308 with secondary oxygen containing gas and through line 309 with tertiary oxygen containing gas. The secondary and tertiary gases consisted of preheated air and oxygen, respectively, and were used to adjust in the upper roasting stage the oxygen content indicated in the table. The calcine was withdrawn through line 310. A gas-solid suspension was fed from the reactor 301 through line 311 to the recycling cyclone 302 and the solids separated therein were recycled through the recycling line 303 into the reactor 301. The exhaust gas discharged through line 312 contained 0.1% to 0.5% $SO_2$ by volume.

In the following Table 8 the yield of gold and the solubility of arsenic in the cyanide leaching are indicated for various additives and oxygen contents. Whereas the addition of sodium compounds gives good results as regards the yield of gold, the solubility of arsenic will be excessively high in that case.

TABLE 8

| | 1% | | 6% | | 10% | | 40% | |
|---|---|---|---|---|---|---|---|---|
| $O_2$ Content → | Gold Yield % | Arsenic Solubility mg/l | Gold Yield % | Arsenic Solubility mg/l | Gold Yield % | Arsenic Solubility mg/l | Gold Yield % | Arsenic Solubility mg/l |
| Without Additive | 75.6 | 56 | 80.2 | 46 | 82.8 | 26 | 84.6 | 20 |
| Additive 1.4% iron ore | 80.0 | 20 | 84.9 | 15 | 87.2 | 18 | 89.0 | 15 |
| Additive 2% $FeSO_4.7H_2O$ | 83.0 | 6 | 89.3 | 4 | 92.0 | 3 | 94.2 | 1 |
| Additive 3.2% $Ca(OH)_2$ | 83.2 | 19 | 89.3 | 18 | 92.2 | 12 | 95.0 | 10 |
| Additive 5% $CaSO_4.2H_2O$ | 82.8 | 10 | 88.1 | 7 | 92.0 | 3 | 94.8 | 2 |
| Additive 2% $Na_2CO_3$ | 82.6 | 70 | 87.9 | 50 | 91.8 | 48 | 96.4 | 50 |
| Additive 2% $Na_2SO_4$ | 83.2 | 65 | 89.6 | 46 | 92.2 | 36 | 95.2 | 40 |

While the above process has been illustrated as capable of treating ores of various particulate sizes, the advantageous size is determined for each ore and is typically from about −14 mesh to about −100 and less. At finer particulate sizes e.g. −100 mesh there is no need to wet grind the calcine after quenching in tank 105 but before leaching.

EXAMPLE 8

Figure 8:
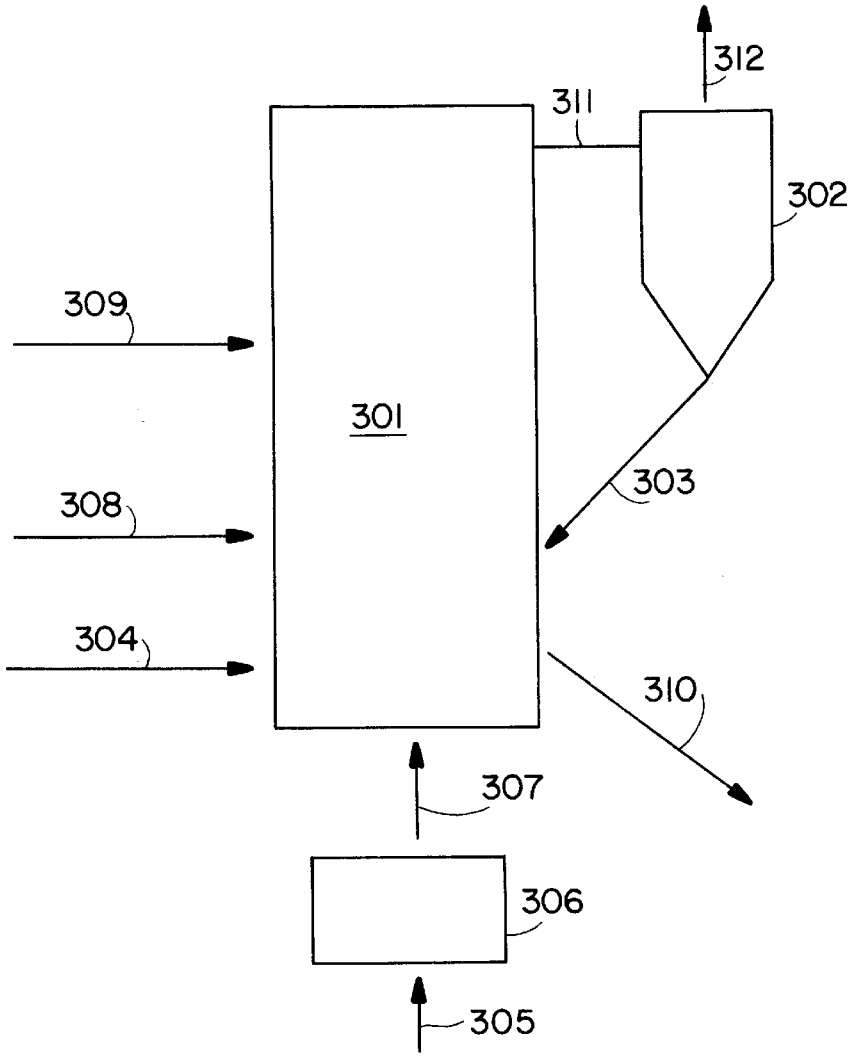
FIG. 8 is a flow chart illustrating the process in accordance with the invention wherein various oxygen amounts are introduced in different sections of a circulating fluid bed.
Figure 10:
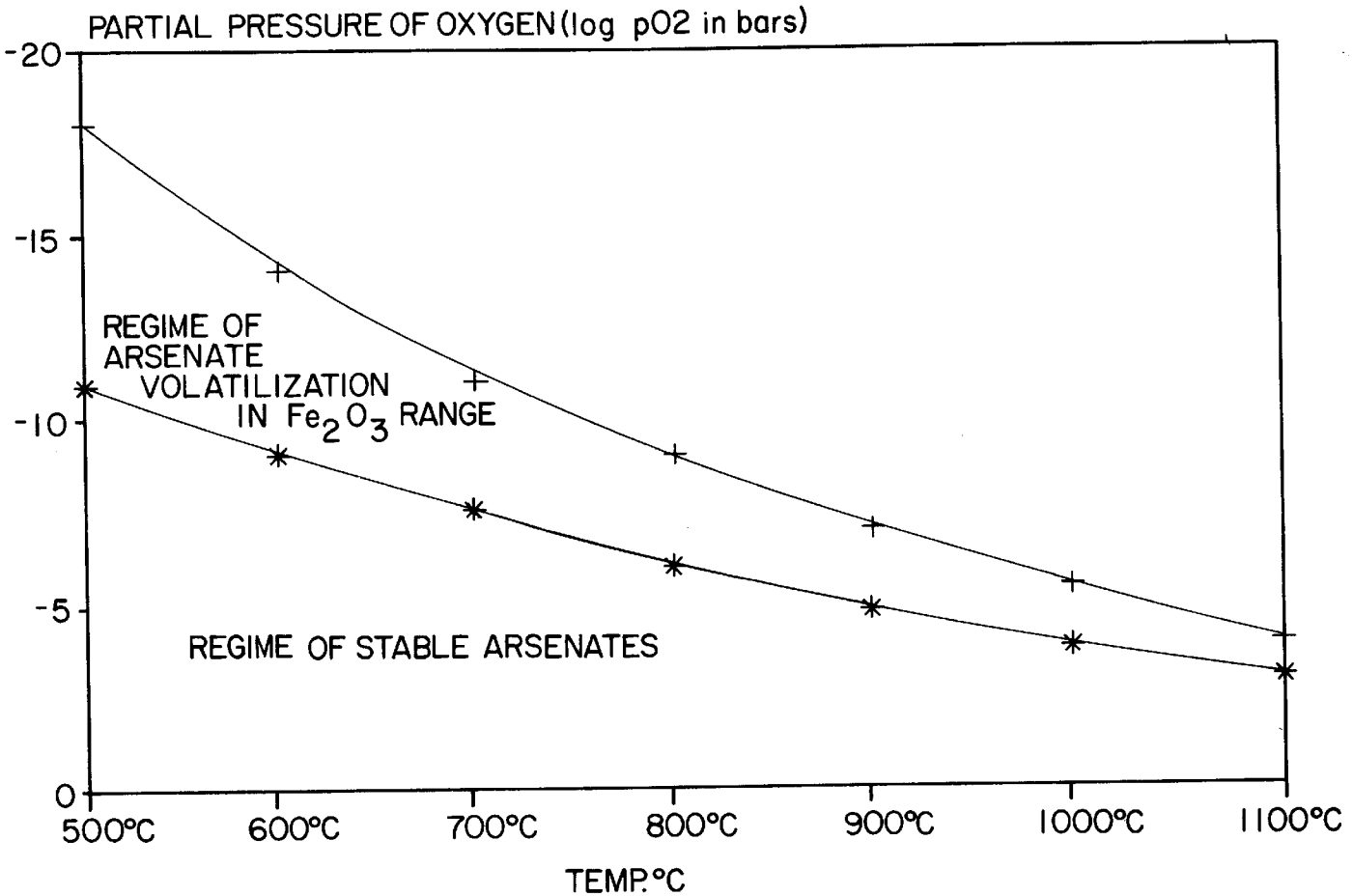
FIG. 10 shows the range in which arsenic is volatilized in the $Fe_2O_3$ range as a function of temperature and oxygen partial pressure.

FIG. 8 illustrates a roasting with two stage oxygen injection carried out in a circulating fluidized bed. The circulating fluidized bed system consists of a fluidized bed reactor 301, a recycling cyclone 302, and a recycling line 303. The fluidized bed reactor 301 was 0.16 m in diameter and had a height of 4 m. By means of a metering screw (not shown) a mixture of refractory gold ore and additives at a rate of 10 kg/h was charged through line 304 into the reactor 301. The gold ore contained 0.8% arsenic, 1.4% sulfide sulfur and 13 g gold per 1000 kg. It had a particle size below 0.1 mm with a median value ($D_{50}$) of 20 $\mu$m. The types and quantities of the additives are apparent from the following Table 8. 80% of the additives had a particle size below 20 to 50 $\mu$m. A gas which contained 0.9% oxygen was fed at a rate of 10 $sm^3/h$ through line 305 into the gas heater 306 and was heated therein to 550° C. and then fed through line 307 into the Based on the experiments described above a representative, schematic presentation of arsenic immobilization is evident from the oxygen content versus temperature curves from soluble and substantially insoluble arsenate formation. While it is evident from the composite curves shown above that as oxygen and temperature increases arsenic immobilization occurs, it is also evident that for efficient leaching such temperatures must be kept below ore component fusion temperatures which prevent good cyanide leaching. At an oxygen partial pressure of $\log.pO_2$ of −3.0, the arsenate (in case of ferricarsenate—as shown in FIG. 10) must be also analyzed as only one component which needs to be considered. Carbon and sulfur must also be eliminated and efficient elimination calls for balancing of temperature and oxygen content. Additional substances such as $CaSO_4.\ 2H_2O$ also favorably immobilize arsenic. Moreover, pyrites in the ore being in intimate contact with arsenic compounds in ore, as shown above, react favorably to immobilize arsenic especially at higher oxygen content in the reactant gas.

EXAMPLE 9

Figure 11:
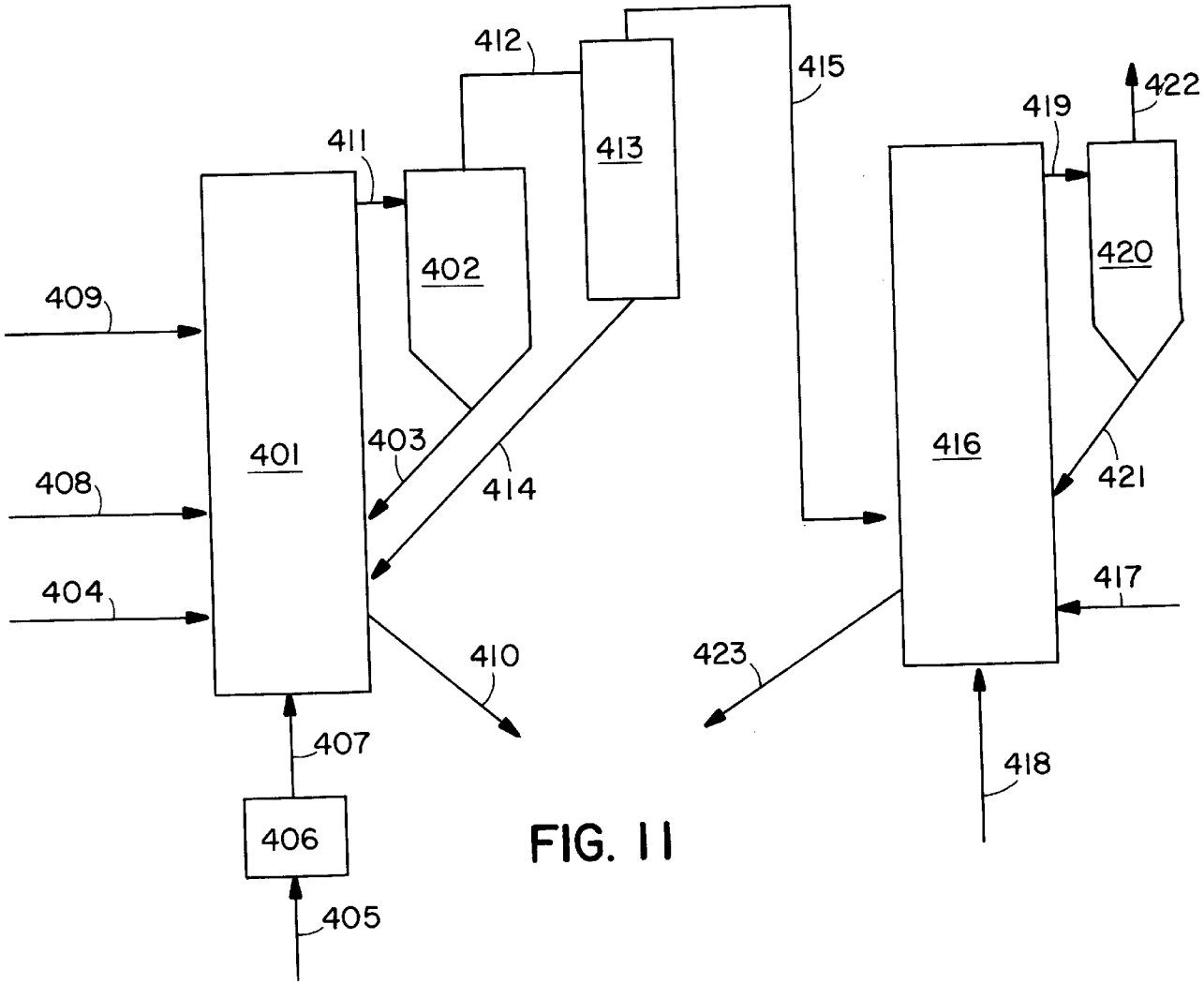
FIG. 11 is another flow scheme illustrating the process in accordance with the invention.

According to FIG. 11 the first circulating fluidized bed system consists of the fluidized bed reactor 401, the recycling cyclone 402, and the recycling line 403. The fluidized bed reactor 401 was 0.2 m in diameter and had a height of 6 m. By a metering screw feeder, gold ore concentrate at a rate of 15 kg/h was charged through line 404 into the reactor. The concentrate contained 2.1% arsenic, 15% sulfide sulfur and 45 g gold per 1000 kg. The particle size was below 0.2 mm with a median size ($D_{50}$) of 70 $\mu$m. Air at a rate of 11 $sm^3/h$ ($sm^3$=standard cubic meter) was fed through line 405 into the heat exchanger 406 and was preheated therein to 600° C. and then fed through line 407 into the reactor 401 as a fluidizing gas. The reactor 401 was fed through line 408 with secondary air at a rate of 9 $sm^3/h$ and through line 409 at a rate of 3 $sm^3/h$ with tertiary air, which served to combust the residual sulfur in the reactor 401. By the distribution of the air supply, the oxygen potential was adjusted to be in the range in which arsenic is volatilized in the $Fe_2O_3$ range (FIG. 10), below the range in which iron arsenate is formed.

The temperature in the reactor was between 700° C. and 750° C. The calcine withdrawn through line 410 contained 0.02% arsenic and 0.1% sulfur. The leaching of the calcine resulted in a recovery of gold with a yield of 96%. The solubility of arsenic during the leaching of gold was very low and amounted only to less than 2 mg/l.

A gas-solid suspension was fed from the reactor 401 through line 411 into the recycling cyclone 402. The solids collected there were recycled through the recycling line 403 into the reactor 401. The exhaust gas conducted in line 412 was dedusted in two cyclones (not shown) and in a candle filter 413 at about 600° C. The collected dusts were returned to the reactor 401 through line 414. The dust-free exhaust gas contained $SO_2$ and $As_2O_3$ and was fed through line 415 to the fluidized bed reactor 416 of a second circulating fluidized bed system.

The reactor 416 was 0.16 m in diameter and had a height of 4 m. It was heated by indirect electric heating. Hematinic iron ore having a particle size below 0.5 mm, with a medium size of 30 $\mu$m, was charged through line 417 at a rate of 0.3 kg/h. Fluidizing air at a rate of 15 $sm^3/h$ was fed into the reactor 416.

Figure 9:
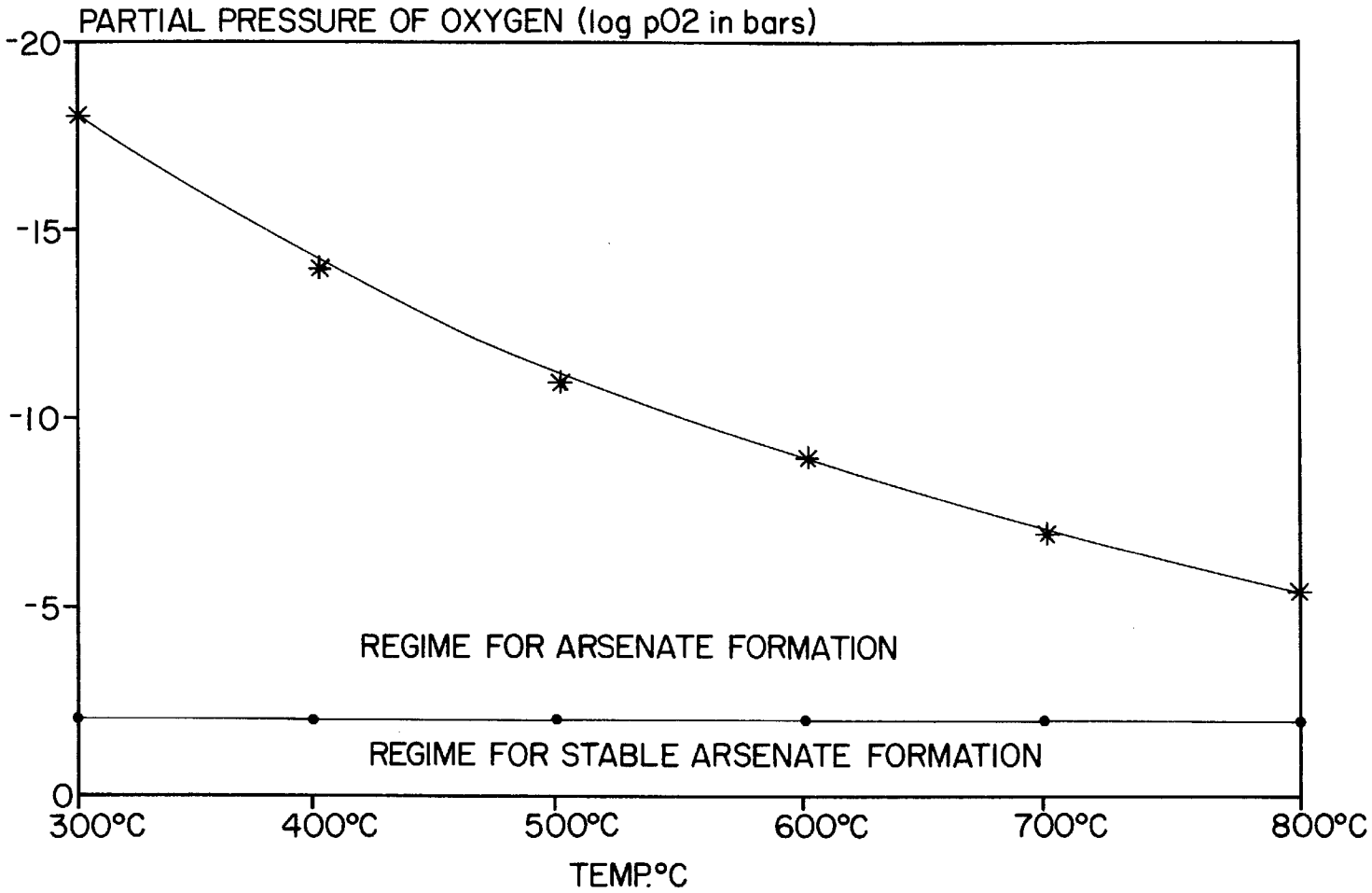
FIG. 9 illustrates the range in which stable arsenates are formed as a function temperature and oxygen partial pressure and in which the process in accordance with the invention is carried out. Some of the arsenates formed in the range in which normal arsenates are formed are water-soluble, however, increased oxygen content in the roasting gas reduces arsenic solubility especially in presence of iron additives, e.g. pyrites, iron oxides or iron sulfates.

The suspension leaving through line 419 was adjusted to contain 6% oxygen and 4% water vapor so that the conditions for a formation of stable arsenates (FIG. 9) were established. To adjust a water vapor content of 4%, the moisture content of the iron ore charged through 417 was controlled in dependence on the water vapor content of the gas entering through line 415 and of the fluidizing air entering through line 418.

The solids collected in the recycling cyclone 420 were returned through the recycling line 421 into the reactor 416. The arsenic-free roaster gas contained 9.1% $SO_2$ and was fed through line 22 to a gas purifier and subsequently to a plant for producing sulfuric acid. The solid material which was discharged through line 423 from the reactor 416 contained 17.3% arsenic. Leaching tests with water (corresponding to a DEV-$S_4$ leaching test) showed that the solubility of arsenic was less than 1 mg/l.

According to a preferred feature of the embodiment shown in Example 9, the dust-containing gases which contain arsenic vapor and arsenic compound vapor(s) are produced by roasting e.g. of sulfide materials which contain iron and arsenic. Such materials are roasted in the $Fe_2O_3$ range at temperatures of 500° C. to 1100° C. in a first stage, which is supplied with oxygen-containing gases. In these materials, arsenic is volatilized mainly as arsenic oxides and part of the sulfur content is volatilized as elementary sulfur. Solids are removed from the exhaust gas at temperatures above the condensation temperature of the volatilized components, and the solids are discharged as calcine.

The sulfide materials may consist of arsenic-containing ores or ore concentrates, such as gold ores, copper ores, silver ores, nickel ores, cobalt ores, antimony ores, lead ores and iron ores as well as of arsenic-containing sulfide residues and intermediate products. By the roasting, a small part of the arsenic content is reacted to form arsenic sulfides. In the processing of gold ores or gold ore concentrates, environmentally acceptable dumps of residues are obtained. Further, a product from which gold can be leached with cyanides in a high yield.

Although the above illustrations concerning metal recovery has been with reference to gold, other precious metal and metal recovery of arsenic containing ores may be practiced as described herein—thereby realizing the advantages of the present process, i.e. low temperature (e.g. less than 700° C.), oxygen enriched air roasting in presence of substances such as iron or calcium to immobilize arsenic as e.g. ferricarsenate in the form of scorodite or scorodite like compounds. Scorodite like compounds are intended to mean compounds of ferricarsenate with water of crystallization of varying mole amounts. For scorodite two moles of water of crystallization is typically shown but the amounts of water crystallization may vary. As shown above, the presence of water of crystallization in the added substance the roasting atmosphere or in the ore components, e.g. aids in the immobilization of arsenic. However, the measure for immobilization, i.e. insolubility, is scorodite and represents the level of insolubility which is desired. A "scorodite like" compound is intended to have insolubility of about the same order of magnitude as scorodite.

Moreover, while the process for gold recovery has been found best conducted with the indicated oxygen levels for other metal recovery from ores which contain arsenic, such process may be practiced with even higher oxygen levels (and also temperature levels) as shown above because the improvement concerning arsenic recovery as such may even be practiced with pure oxygen used as the oxidizing medium. When using higher temperatures, i.e. as shown in Example 9, the combination of first stage and second stage treatment provides a double measure of safety that any arsenic which may have been volatilized may be separately immobilized to assure an environmentally double safe treatment of any off gas. Such combination also provides for employment choice of a lower oxygen content in first stage and higher in the second stage. In part such effect may also be achieved by the multiple oxygen injection as shown for the gold ores treated in the combination shown in Example 8.

Because of these advantages including those derived from e.g. circulating fluidized beds, the present invention provides improvements over those shown by the prior art as previously described and pointed out with reference to that art.

While the exact reasons that cause the process of the present invention to produce the herein-observed results are unknown and could not be predicted, the results themselves bespeak the achievements that have been obtained—based merely on the percent of gold extraction and arsenic immobilization—from these refractory ores at great savings of oxygen usage and using a less complicated approach than the best prior art technology can show. It is especially noted for conditions such as apply when using a circulating fluidized bed which provides for significant heat recovery and reutilization.

It is also evident from the above that various combinations and permutations may well be practiced and advanced, but these are not to be understood as limiting the invention which has been defined in the claims which follow.

What is claimed is:

1. A process for treating ores in the form of ore particles, having recoverable precious metal values and metal values and including arsenic-, carbon- and sulfur-containing components which comprises:

roasting said ore particles in the presence of at least one substance selected from the group consisting of:

i. a free oxide, carbonate, sulfate, hydroxide and chloride of calcium, magnesium, iron and barium;

ii. a pyrite; and iii. iron;

in an oxygen augmented atmosphere having a total initial oxygen content of less than about 65% by volume while maintaining a reaction temperature from about 475° C. to about 900° C. during said roasting, without formation of a molten phase on the surface of said ore particles and further wherein said substance is present in an amount at least 1 to 4 times the stoichiometric amount necessary, at least 3.5 times when said substance comprises iron, on mol basis, to react with arsenic in said ore to form stable arsenates;

roasting said ore in presence of water vapor up to 10% by weight of said ore such that the water vapor content in an exhaust gas from said roasting is 0.5 to 10%; and recovering a thus-roasted ore as calcine whereby said calcine is amenable to recovery of precious metal values in said calcine.

2. A process for treating ore in accordance with claim 1 in which said precious metal is gold.

3. A process for treating ore in accordance with claim 1 in which said ore particles in said gaseous atmosphere are being treated as fluidized solids during roasting and are of a particulate size sufficient to achieve said roasting within a fluidized bed.

4. A process for treating ore in accordance with claim 3 in which said process further comprises:

recirculating said ore in said gaseous atmosphere as fluidized solids during roasting.

5. A process for treating ore in accordance with claim 1 in which said roasting is in a single stage recirculating fluidized bed wherein said ore particles are maintained for a time and at a temperature sufficient to roast said ore particles without sintering said ore particles or having a molten phase form on said ore particles and wherein sufficient roasting is in presence of oxygen injected at least once in said recirculating fluid bed to convert said arsenic values to an arsenate.

6. A process for treating ore particles in accordance with claim 1 in which said process further comprises:

rendering said ore amenable to recovery of the precious metal values by leaching and wherein roasting is without volatilization of the arsenic values from said ore during said roasting.

7. A process for treating ore particles in accordance with claim 6 in which said process comprises leaching said ore particles after roasting and recovering gold from these.

8. A process for treating ore particles in accordance with claim 7 in which, prior to leaching, cyanide consuming materials are removed from said ore and, thereafter, said ore is leached with a carbon-in-leach or a carbon-in-pulp cyanide leachant.

9. A process for treating ore material having precious metal content in accordance with claim 1 in which said process further comprises:

treating said ore material with chlorine or oxygen in a bath at ambient pressure or in a closed zone at ambient or elevated pressure, after roasting and prior to leaching.

10. A process for treating an ore material in accordance with claim 1 in which at least a portion of said oxygen-enriched gaseous atmosphere is recovered and augmented with additional oxygen when the final oxygen content of said atmosphere is lower than necessary for recirculation to a fluidized bed.

11. A process for treating ore in accordance with claim 1 in which the oxygen content of said gaseous atmosphere and the reaction temperature are sufficient to achieve reaction of said arsenic-containing components in presence of iron in said ore, and wherein iron is present in said ore as iron pyrite and said reaction is being conducted without substantial volatilization of the arsenic values in said ore.

12. A process as defined by claim 1 in which the reaction temperature is from about 475° C. to about 600° C.

13. A process as defined in claim 1 in which the reaction temperature is from about 500° C. to 550° C.

14. The process of claim 1, wherein said at least one substance is selected from the group consisting of:

i. a free oxide, carbonate, sulfate, hydroxide and chloride of magnesium, iron and barium;

ii. a pyrite; and iii. iron.

15. The process of claim 1, wherein said oxygen-enriched gaseous atmosphere is oxygen augmented air.

16. The process of claim 1, wherein the oxygen-enriched gaseous atmosphere has an oxygen content between about 20% to about 50% by volume.

17. The process of claim 1, further comprising the step of injecting oxygen into said atmosphere during said roasting.

18. The process of claim 1, wherein the oxygen-enriched gaseous atmosphere has an oxygen content between about 25% to about 60% by volume.

19. A process of roasting refractory gold ores or gold ore concentrates in a particle form characterized in that the roasting is carried out a) at temperatures which are between 450° C. to 900° C. and below the temperature at which a molten phase is formed within or on said particle;

b) in an oxygen augmented atmosphere that contains more than 20% but less than about 65% oxygen by volume in said atmosphere;

c) in the presence of one or more substances selected from the group consisting of:

i. free oxide, carbonate, sulfate, hydroxide, and chloride of calcium, magnesium, iron, and barium, ii. pyrites, and iii. iron, in an amount which is in excess of the amount which is stoichiometrically required to form stable arsenates; and d) in the presence of water vapor in an amount up to 10% by volume of said atmosphere such that the water vapor content in an exhaust gas from said roasting is 0.5 to 10%.

20. A process according to claim 19 characterized in that the roasting treatment according to a) to d) is preceded by a first roasting stage, in which roasting is effected at a temperature between 450° C. and 900° C. and below the temperature at which a molten phase is formed in or on the surface of said particle and in an oxygen-containing atmosphere having an oxygen content below 1% by volume.

21. A process according to claim 19 characterized in that a member of the group as defined in c) is added in a particle size below about 1 mm.

22. A process according to claim 19 characterized in that a substance which is a member of the group as defined in c) has a particle size, for 80% by weight of the particles of which the substance is comprised of a size below 10 to 50 $\mu$m.

23. A process according to claim 19 characterized in that the water vapor content in the gas atmosphere according to d) is between about 0.5% to 10% by volume.

24. A process according to claim 19 characterized in that the oxygen content of the gas according to b) is between about 20% to 50% by volume.

25. The process of claim 19, wherein said at least one substance is selected from the group consisting of:

i. a free oxide, carbonate, sulfate, hydroxide and chloride of magnesium, iron and barium;

ii. a pyrite; and iii. iron.

26. The process of claim 19, wherein said oxygen-containing atmosphere is oxygen augmented air.

27. The process of claim 19, further comprising the step of injecting oxygen into said atmosphere during said roasting.

28. The process of claim 19, wherein the oxygen-containing atmosphere has an oxygen content between about 25% to about 60% by volume.

* * * * *